US009068453B2

(12) United States Patent
Rohwer et al.

(10) Patent No.: US 9,068,453 B2
(45) Date of Patent: Jun. 30, 2015

(54) MOBILE MINING MACHINE AND METHOD FOR DRIVING TUNNELS, ROADWAYS OR SHAFTS, IN PARTICULAR IN HARD ROCK

(75) Inventors: Jan Rohwer, Dortmund (DE); Jens Steinberg, Lünen (DE); Joachim Raschka, Bochum (DE); Frank Herrmann, Chemnitz (DE); Christian Schreiter, Drebach (DE); Ulrich Bechem, Hagen (DE); Oliver Kortmann, Werne (DE); Johannes Krings, Lünen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 14/116,651

(22) PCT Filed: Apr. 24, 2012

(86) PCT No.: PCT/IB2012/052057

§ 371 (c)(1),
(2), (4) Date: Dec. 12, 2013

(87) PCT Pub. No.: WO2012/156843

PCT Pub. Date: Nov. 22, 2012

(65) Prior Publication Data

US 2014/0091612 A1 Apr. 3, 2014

(30) Foreign Application Priority Data

May 16, 2011 (DE) ..... 10 2011 050 387
Sep. 30, 2011 (DE) ..... 10 2011 114 589

(51) Int. Cl.

| | |
|---|---|
| ***E21C 31/10*** | (2006.01) |
| ***E21C 27/24*** | (2006.01) |
| ***E21D 9/10*** | (2006.01) |

(52) U.S. Cl.

CPC ..... *E21C 27/24* (2013.01); *E21D 9/1026* (2013.01); *E21D 9/1093* (2013.01)

(58) Field of Classification Search

CPC ..... E21D 9/128; E21C 31/10
USPC ..... 299/85.1, 78, 73
See application file for complete search history.

(56) References Cited

U.S. PATENT DOCUMENTS 2,619,338 A * 11/1952 Lindgren ..... 299/67
3,000,620 A * 9/1961 Densmore ..... 299/64

(Continued)

FOREIGN PATENT DOCUMENTS

DE 288 984 5/1915
DE 24 47 604 4/1976

(Continued)

OTHER PUBLICATIONS

International Search Report and Written Opinion for International Application No. PCT/IB2012/052057, dated Apr. 5, 2013, 8 pages.

*Primary Examiner* — John Kreck

(57) ABSTRACT

A mobile mining machine includes a movable machine base frame having a boom, a swinging device for swinging the boom, and a tilting device for tilting the boom. At least one tool drum is coupled to the boom for rotation about a drum axis and rotatable tool carriers are arranged on a circumference of the tool drum. The boom has a supporting arm, on which the tool drum is mounted, and a separate swinging base, which is swingable about a swing axis in relation to the machine base frame by the swinging device. The supporting arm and the swinging base are connected to one another by a system of guide bars, by way of which a setting angle of the drum axis in relation to the swing axis is adjustable.

38 Claims, 11 Drawing Sheets

(56) References Cited

U.S. PATENT DOCUMENTS

| | | | | |
|---|---|---|---|---|
| 3,121,558 | A * | 2/1964 | Gonski et al. | 299/64 |
| 4,548,442 | A | 10/1985 | Sugden et al. | |
| 5,234,257 | A | 8/1993 | Sugden | |
| 5,333,936 | A * | 8/1994 | Zitz | 299/64 |
| 7,631,942 | B2 | 12/2009 | Bechem et al. | |
| 2005/0200192 | A1 | 9/2005 | Sugden | |
| 2008/0116734 | A1 * | 5/2008 | Bechem et al. | 299/10 |
| 2010/0001574 | A1 * | 1/2010 | Bechem | 299/10 |

FOREIGN PATENT DOCUMENTS

| | | | | |
|---|---|---|---|---|
| DE | 33 16 840 | | 11/1984 | |
| DE | 3316840 | A1 * | 11/1984 | E21D 9/10 |
| DE | 44 40 498 | | 8/1995 | |
| RU | 2039284 | C1 | 7/1995 | |
| WO | WO 02/066793 | | 8/2002 | |
| WO | WO 2010/050872 | | 5/2010 | |

* cited by examiner

MOBILE MINING MACHINE AND METHOD FOR DRIVING TUNNELS, ROADWAYS OR SHAFTS, IN PARTICULAR IN HARD ROCK

CROSS-REFERENCE TO RELATED APPLICATIONS

This application claims the benefit of priority to international patent application number PCT/IB2012/052057, having a filing date of Apr. 24, 2012, which claims the benefit of priority to German patent application number DE102011050387.0, having a filing date of May 16, 2011 and German patent application number DE102011114589.7, having a filing date of Sep. 30, 2011, the complete disclosures of which are all hereby incorporated by reference for all purposes.

TECHNICAL FIELD

The invention relates to a mobile mining machine, in particular for driving tunnels, roadways or shafts in hard rock and the like, with a movable machine base frame, with at least one tool drum, which can be rotated about a drum axis and has stripping tools arranged on the circumference of the tool drum, with a rotary drive for the tool drum, with a boom device, on which the tool drum is rotatably mounted, with a swinging device for swinging the boom device in relation to the machine base frame, and with a tilting device for tilting the boom device. The invention also relates to a method for driving tunnels, roadways or shafts in hard rock or the like with a mobile mining machine which has a movable machine base frame and at least one tool drum, which is mounted on a boom device, can be rotated about a drum axis and has stripping tools arranged on the circumference of the tool drum, and also a swinging device for swinging the boom device about a swing axis, the removal of material from the working face being performed by swinging the boom device about the swing axis and material being removed at the working face with the rotating tool drum during the swinging operation in both swinging directions.

BACKGROUND

In tunnel mining, movable (mobile) mining machines with which a tunnel shaft can be driven, in particular even in hard rock, have long been known. Corresponding tunnel boring machines, which have a cutting wheel as a tool drum on the front side of a machine frame, with cutting discs arranged on the circumference of the cutting wheel, are known for example from U.S. Pat. No. 4,548,442 or U.S. Pat. No. 5,234,257.

The invention is based on a mining machine and a method according to WO 2010/050 872 A1. The corresponding machine is intended both for driving tunnels and also generally for mining extraction and operates like the other known tunnel boring machines with a tool drum which rotates about a drum axis and on the circumference of which a multiplicity of stripping tools in the form of cutting discs are arranged in a distributed manner and directed radially outwards. By means of a boom, at the front end of which the tool drum is mounted, and a swinging device, with which the boom can be swung in relation to the movable machine base frame, the removal of material at the working face, also known as the drift or heading face, is performed ahead of the cutting head by swinging the cutting head back and forth. In the case of the mobile mining machine known from WO 2010/050 872, the cutting discs can rotate freely in their suspension, the cutting discs being arranged distributed over the circumference of the tool drum in such a way that the axes of rotation of some cutting discs are parallel to the axis of rotation of the tool drum and the axes of rotation of other cutting discs are oblique to the axis of rotation of the tool drum. The distributed arrangement of a multiplicity of cutting discs is intended to have the effect that, with every swinging movement, material is only partially removed with each cutting disc, in order in this way to minimize the stressing of the individual cutting discs and to this extent the wear of the stripping tools on the cutting wheel. The swing axis for the swinging movement extends essentially perpendicularly, at least to the undercarriage of the machine base frame, and the boom can be raised or lowered by way of a tilting cylinder, in order to extract material with the cutting wheel at different heights or seams. According to one configuration, the swinging movement of the tool drum is performed along an arcuate face, which is formed at the front end of the boom. Furthermore, WO 2010/050 872 also discloses a configuration of a mining machine in which there are two or three cutting wheels, these cutting wheels then respectively being able to swing inwards and outwards in relation to the machine base frame about a swing bearing. The individual cutting wheels are intended in this case to be suspended from a frame, which can be turned about the longitudinal axis of the tunnel in order to allow a tunnel to be driven and advanced with the oppositely movable cutting wheels, which themselves can only be swung perpendicularly to the axis of rotation of the tool drum, by turning of the frame receiving the number of cutting wheels.

Apart from driving tunnels with cutting discs, which are in principle passively cutting, the applicant's US 2010/001 574 A1 or U.S. Pat. No. 7,631,942 B2 also discloses mining machines that operate in a milling or drilling manner with self-rotating stripping tools arranged on a rotatable drum. The actual stripping tools on these mining machines consist of individual cutter tips, which rotate, usually at a high rotational speed, about the axis of rotation of a tool carrier, a number of tool cutters being respectively arranged on a tool carrier and at the same time the rotation of the tool drum having the effect that only individual cutters of a tool carrier are respectively in contact briefly with the rock to be extracted. Since in the case of these mining machines only a few cutter tips or only a single cutter tip is/are respectively in contact with the rock to be extracted, a relatively low pressing force is required, although nevertheless a high stripping force can be achieved.

SUMMARY

The object of the invention is to provide a mobile mining machine with which the driving or advancing of tunnels, roadways or shafts can be brought about even in hard rock with a high extraction rate and low tool wear.

This object is achieved with a mobile mining machine as further described herein according to exemplary embodiments of the disclosure.

In the case of the mobile mining machines according to the invention, it is provided that the boom device has a supporting arm, on which the tool drum is mounted, and a separate swinging base, which can be swung in relation to the machine base frame by means of the swinging device, the supporting arm and the swinging base being connected to one another by means of a system of guide bars for adjusting the setting angle of the drum axis in relation to the swing axis. Consequently, the setting angle of the drum axis in relation to the swing axis can be adjusted by way of the system of guide bars. This system of guide bars that is provided in the case of the mobile mining machine according to the invention allows the setting angle of the drum axis in relation to the swing axis to be adjusted and to this extent also the setting angle of individual stripping tools to be adjusted individually in dependence on the tilting position of the boom device and the swinging direction for the swinging operation in one swinging direction and the swinging operation in the other swinging direction, whereby for example certain stripping tools on the tool drum come into contact with the rock to be extracted only in the case of one swinging movement and other stripping tools come into contact with the rock to be extracted in the case of the opposite swinging movement, for which reason there is then no risk of the stripping tools that are not performing any extraction work for the respective swinging operation being touched or worn by material to be removed at the drift or heading face, because the setting angle can be set in such a way that the inactive tools are then in the shadow of those stripping tools that are intended to perform the stripping work at the drift or heading face. At the same time, with the tilting position changed, the setting angle can be adapted, and thereby optimized. The additional possibility of adjusting the setting angle of the tool drum in relation to the axis of rotation allows the stripping behaviour and the removal of material to be considerably improved, with at the same time reduced wear, in a surprisingly simple way, while at the same time the system of guide bars makes it possible for the adjustment of the setting angle to be handled in a way that is stable, less likely to cause wear and comparatively simple, even in the case of great dead weights of the tool drum.

In the case of one configuration of a mobile mining machine, the system of guide bars forms a four-bar linkage, in particular an isosceles trapezoidal four-bar linkage, for which purpose the system of guide bars preferably has a first guide-bar bracket on the supporting arm side and a second guide-bar bracket on the swinging base side, which are connected by way of guide-bar arms. It is particularly advantageous if the first guide-bar bracket is connected to the supporting arm in a fixed manner and the second guide-bar bracket is connected to the swinging base in a tiltable manner, the tilting device for tilting the second guide-bar bracket then preferably being arranged between the second guide-bar bracket and the swinging base. By way of the tilting device, the second guide-bar bracket is connected to the swinging base in a tiltable manner. Here, the tilt axis preferably runs perpendicularly in relation to the swing axis. By tilting the second guide-bar bracket, the height of the drum axis, and thereby the seam or level at which material is removed with the rotatable tool drum and the stripping tools attached thereto, can be changed in a simple way and mechanically detached from the possibility of changing the setting angle that is created by the guide-bar system.

The guide-bar system may possibly have just two guide-bar arms, preferably of the same length, which are respectively mounted with their one guide-bar end on the first guide-bar bracket and with their other guide-bar end on the second guide-bar bracket, in each case rotatably about guide-bar axes. The distance between the guide-bar axes on the second guide-bar bracket is preferably greater here than the distance between the guide-bar axes on the first guide-bar bracket. The guide-bar axes themselves preferably run perpendicularly in relation to the drum axis, while the tilting device preferably makes it possible for the guide-bar axes to be inclined in relation to the swing axis.

According to one configuration, the rotary drive may be positioned between the guide-bar arms. This configuration has the particular advantage that essentially the tool drum only has to be provided with one electrical and/or hydraulic supply, with which the system of guide bars between the supporting arm and the swinging base has to be bridged. Suitable flexible tubes, with which the system of guide bars is bridged, are then preferably sufficient for the electrical, hydraulic and/or pneumatic supply to the rotary drive. The rotary drive may advantageously be flange-mounted on the first guide-bar bracket or on the rear side of the supporting arm. According to a particularly advantageous configuration, the guide-bar brackets may be movable in relation to one another by means of two actuating drives in a crosswise arrangement, one actuating drive, above the rotary drive, and the second actuating drive, below the rotary drive, preferably connecting the guide-bar brackets to one another. The actuating drives may include for example hydraulically operable cylinders or electric linear motors. In order to have sufficient space available for arranging the rotary drive, the guide-bar arms may be respectively provided with a crank, which is preferably arranged off-centre, and particularly in the mounted state lies closer to the second guide-bar bracket on the swinging base side than to the first guide-bar bracket.

The tilting device may comprise at least one lifting cylinder, which is fastened with one cylinder end to a cylinder stop on the swinging base and with its other end to a cylinder stop preferably arranged in the middle of the second guide-bar bracket. The swinging base may be arranged on a longitudinally displaceable carriage device, which makes it possible for the cutting depth to be adjusted even without travelling movement of the mining machine.

According to another configuration, the stripping tools consist of rotatable tool carriers with a number of tool cutters, in particular round-shank cutters, which are arranged on a carrier head of the tool carriers and with which particularly effective stripping, and to this extent material removal of relatively small, chip-like fragments of rock, can be achieved even from hard rock, as specifically described in its basic principles in US 2010/001 574 A1 or U.S. Pat. No. 7,631,942 B2.

According to another configuration of a mobile mining machine, two groups of rotatable tool carriers fitted with cutters are used as stripping tools on the circumference of the tool drum, which can be adjusted in its setting in relation to the rock to be extracted by means of the system of guide bars, the axes of rotation of the tool carriers of both groups of stripping tools being oblique to the drum axis and the axes of rotation of the one group, consequently all the tool carriers of the first group, being oblique to the drum axis by an angle of $90°+\alpha$ and the axes of rotation of the other group, i.e. the second group of tool carriers, being oblique to the drum axis by an angle of $90°-\alpha$. The axes of rotation of one group of tool carriers are consequently arranged obliquely to one side with respect to the centre plane of the tool drum and the axes of rotation of the second group are arranged obliquely to the other side, whereby essentially an X arrangement of the axes of rotation of the first group in relation to the axes of rotation of the other group is obtained. The symmetrical arrangement of the oblique positioning by the same angle $\alpha$ has advantages, particularly for the loading of the rotary bearings of the tool drum. Preferably a number of tool cutter groups are formed on each tool carrier, the angular offset of all the tool cutters of a tool cutter group, consequently a group of tool cutters arranged on the same pitch circle, in relation to one another preferably being the same and the tool cutter groups having different radial distances from the axis of rotation of the tool carrier and/or different radial distances from the drum axis. The stripping tools may consequently have a number of cutters, which are arranged on different pitch circles and at the same time are preferably also arranged at different distances from the drum axis. According to a particularly preferred configuration, the tool carriers of one group are preferably able here to be rotated or driven oppositely to the tool carriers of the second group, in order that all of the material stripped by the tool cutters is broken out from the drift or heading face in the same direction of movement, and thereby preferably knocked off downwards, since only the cutters of one group of stripping tools ever perform the stripping work.

According to an alternative configuration, two tool drums are mounted on the supporting arm. According to one variant, with the same direction of rotation of the two tool drums, the tool carriers on the first tool drum are able to be rotatably driven or are rotatably driven oppositely to the tool carriers on the second tool drum. Alternatively or in addition, the axes of rotation of the tool carriers on the first tool drum and the axes of rotation of the tool carriers on the second tool drum are oblique to the drum axis and the axes of rotation of the tool carriers on one tool drum are oblique to the drum axis of the first tool carrier by an angle of $90°+\alpha$ and the axes of rotation of the tool carriers on the second tool drum are oblique to the drum axis of the second tool drum by an angle of $90°-\alpha$.

According to another alternative configuration, two tool drums may also be mounted on the supporting arm, the drum axes of which are oblique to one another, preferably v-shaped, the tool carriers on the first tool drum preferably being able to be rotatably driven or being rotatably driven oppositely to the tool carriers on the second tool drum. The direction of rotation of the two tool drums may turn out to be the same here and the axes of rotation of all the tool carriers may be respectively normal to the associated drum axis.

In the case of all the variants, the angle $\alpha$, by which the axes are oblique to one another, preferably lies between approximately 3° and 9° and is in particular approximately $6°\pm1°$.

In order to achieve continuous removal of material and at the same time transport of extracted or stripped material away, a loading ramp with movable gripping fingers is also preferably arranged on the front side of the mining machine, the loading ramp preferably being coupled at its rear end to a transporting belt for transporting away the material stripped with the stripping tools on the preferably single tool drum.

In order with a mobile mining machine to be able to bring about the driving or advancing of tunnels, roadways or shafts and removal of material for mineral extraction even in hard rock with a high extraction rate and low tool wear even when the height of the tunnel, the height of the roadway or the width of the roadway is considerably greater than the diameter of the drum, and therefore removal of material must under some circumstances be performed at different levels one after the other, in the case of a mobile mining machine according to yet a further embodiment it may be provided that the swinging base is arranged together with the swinging device on a swinging arm and a further swinging joint is provided between the swinging arm and the machine base frame as a swing bearing for the swinging arm for the lateral displacement of the position of the swing axis with respect to a longitudinal centre axis of the machine base frame.

When removing material at a working face by horizontally swinging the tool drum provided with the removal tools, the circular geometry of the drum causes raised portions of unremoved material, also referred to as slugs, to occur at the edge of the material that is removed. If the working face is removed at different heights, for example at three cutting heights, such raised portions or slugs respectively occur between two adjacent cutting levels and possibly should not be passed through with the tools on the tool drum perpendicularly to the swinging direction, that is vertically, in order to spare the tools and the machine. By providing a swinging arm that is able to swing for the lateral displacement of the swing axis, tilting of the boom and consequently a height adjustment of the drum axis, can be performed for a second material-removing swing at a different extraction height without the mining machine having to be moved or the entire boom device along with the swing bearing having to be retracted. Rather, it is sufficient to swing the swing arm by a few angular degrees, since in this way the position of the swing axis is displaced to the other side respectively of the longitudinal centre plane and a height adjustment of the tool drum is possible without the tools on the tool drum coming into contact with the raised portion of unremoved material (slug) at the upper or lower edge of the removed working face.

It is particularly advantageous in the case of this configuration if the system of guide bars forms a four-bar linkage, preferably a trapezoidal four-bar linkage, and has a first guide-bar bracket on the supporting arm side and a second guide-bar bracket on the swinging base side, which are connected by way of guide-bar arms.

According to a possible configuration of such a mining machine, the first guide-bar bracket may be connected to the swinging base in a fixed manner and the second guide-bar bracket may be connected to the supporting arm in a tiltable manner, the tilting device being arranged between the second guide-bar bracket and the supporting arm. The guide-bar brackets are expediently movable in relation to one another by means of an actuating drive. The tilting device preferably has at least one lifting cylinder, which is fastened with one cylinder end to a cylinder stop on the supporting arm and with its other end to a cylinder stop arranged on the first guide-bar bracket.

It is particularly advantageous if the swing bearing for the swinging arm is arranged on a longitudinally displaceable carriage device, which makes it possible for the cutting depth to be adjusted without movement of the mining machine. In the case of this configuration, a number of cuts can then be performed without moving the machine. The cuts may either be performed one after the other at the same height at the working face, it then also being required under some circumstances for the carriage device to be refracted into the starting position before a swing back for a height adjustment is performed, or removal of material is performed in each case with a full swing or two partial swings for each extraction height, the boom device only been tilted to the adjacent height once the swinging arm has been swung back, in order to create the necessary space, to then remove material at the working face with the tool drum by a full swing or partial swing at this height.

The stripping tools may here too consist of rotatable tool carriers with a number of tool cutters, in particular round-shank cutters, arranged on the carrier head of the tool carriers. Furthermore, it is particularly advantageous if two tool drums are mounted on the supporting arm, the tool carriers on the first tool drum preferably being able to be rotatably driven or being rotatably driven oppositely to the tool carriers on the second tool drum, more preferably the axes of rotation of the tool carriers on the first tool drum and the axes of rotation of the tool carriers on the second tool drum being oblique to the associated drum axis and the axes of rotation of the tool carriers on the first tool drum being oblique to the drum axis by an angle of $+\alpha$ and the axes of rotation of the tool carriers on the second tool drum being oblique to the drum axis by an opposite angle of $-\alpha$.

According to a further advantageous configuration, the swinging arm may be formed as a swinging block, which at an end on the machine side is supported on the swing bearing and at the end on the boom side supports the swinging base in a manner allowing swinging.

The aforementioned object is also achieved with a method for driving or advancing tunnels, roadways or shafts in hard rock or the like with a mobile mining machine, in which method the setting angle of the drum axis of the tool drum in relation to the swing axis being adjusted before and/or after each removal of material by operating a system of guide bars arranged between the supporting arm and the material base frame.

It is particularly advantageous if the system of guide bars is arranged between a swinging base, which is swung in relation to the machine base frame by means of the swinging device, and the supporting arm, on which the tool drum is mounted.

According to a variant of the method, the removal of material at the working face is performed from the middle outwards in a partial swing, the boom device being adjusted after each removal of material and/or being refracted before the adjustment of the setting angle. The adjustment may be performed in stages, the setting angle being set in a first stage to zero or tangential to the swing radius and a renewed secantal setting of the drum axis in relation to the swing radius only being chosen shortly before the subsequent material-removing partial swing. When there is a temporary retraction of the mining machine, the setting angle can possibly be continuously changed during the swinging operation towards the middle.

According to an alternative variant of the method, an infeeding movement of the mining machine or the boom device may be performed after each removal of material, in particular only after adjusting the setting angle to a central tangential position of the drum axis. In particular in the case of this variant, a further adjustment of the setting angle may then possibly be performed before or during the material-removing swinging operation.

When conducting the method with a mobile mining machine in which the stripping tools on the tool drum consist of rotatable tool carriers with a number of tool cutters, in particular round-shank cutters, arranged on the carrier head of the tool carriers, two groups of stripping tools being arranged on the circumference of the tool drum, the axes of rotation of the tool carriers of both groups being oblique to the drum axis and the tool carriers of the first group being able to be rotatably driven or being rotatably driven oppositely to the tool carriers of the second group, an adjustment of the setting angle can only be performed partially or in steps, the setting angle being set preferably during the infeeding movement in such a way that material is removed with tool cutters of all the tool carriers when cutting-in is carried out in preparation for the next swinging operation.

In the case of a further alternative variant of the method for driving or advancing tunnels, roadways or shafts in hard rock or the like with a mobile mining machine, in which the swinging base is arranged together with the swinging device on a swinging arm and a further swinging joint is provided between the swinging arm and the machine base frame as a swing bearing for the swinging arm, according to the method the position of the swing axis with respect to a longitudinal centre axis of the machine base frame can be laterally displaced by swinging of the swinging arm preferably before and/or after each swinging operation. The presence of a swinging arm that is able to swing for the lateral displacement of the swing axis allows tilting of the boom, and consequently a height adjustment of the drum axis, to be performed for a second material-removing swing at a different height without the mining machine having to be moved or the entire boom device along with the swing bearing having to be retracted. Rather, it is sufficient to swing the swinging arm by a few angular degrees, since in this way the position of the swing axis is displaced to the other side respectively of the longitudinal centre plane and a height adjustment of the tool drum is possible without the tools on the tool drum coming into contact with the raised portion of unremoved material (slug) at the upper or lower edge of the removed working face.

According to an advantageous configuration of this variant of the method, the system of guide bars may be arranged between a swinging base, which is swung in relation to the machine base frame by means of the swinging device for the removal of material, and the supporting arm, on which the tool drum is mounted. According to an advantageous way of conducting the method, the swing axis may be positioned laterally in relation to the longitudinal centre axis during the swinging operation and the position of the swing axis is preferably changed, at least before a tilting of the boom device, by moving the swinging arm, and consequently a swing back is performed by way of the swinging arm.

BRIEF DESCRIPTION OF THE DRAWINGS

Further advantages and configurations of a mobile mining machine according to the invention emerge from the following description of an advantageous exemplary embodiment of a mobile mining machine that is schematically shown in the drawing, in which.

DETAILED DESCRIPTION

Figure 1:
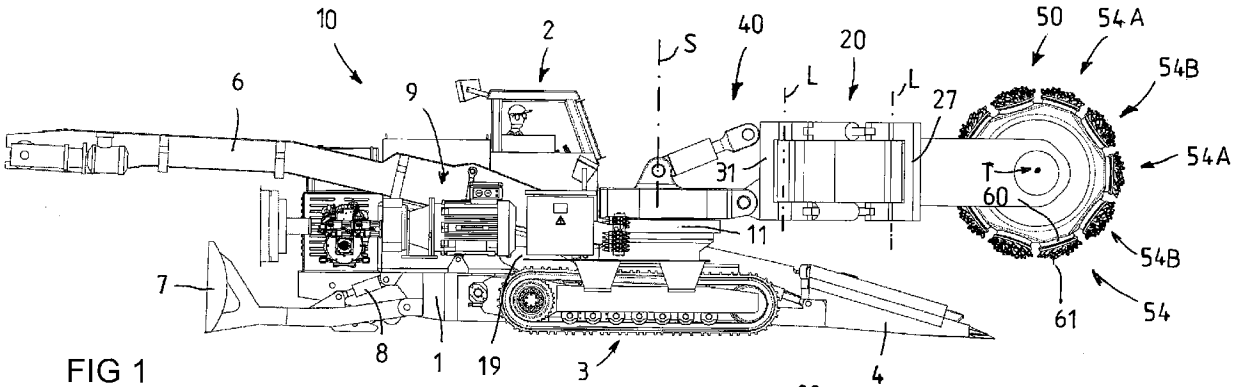
FIG. 1 schematically shows a mobile mining machine according to the invention in side view.
Figure 2:
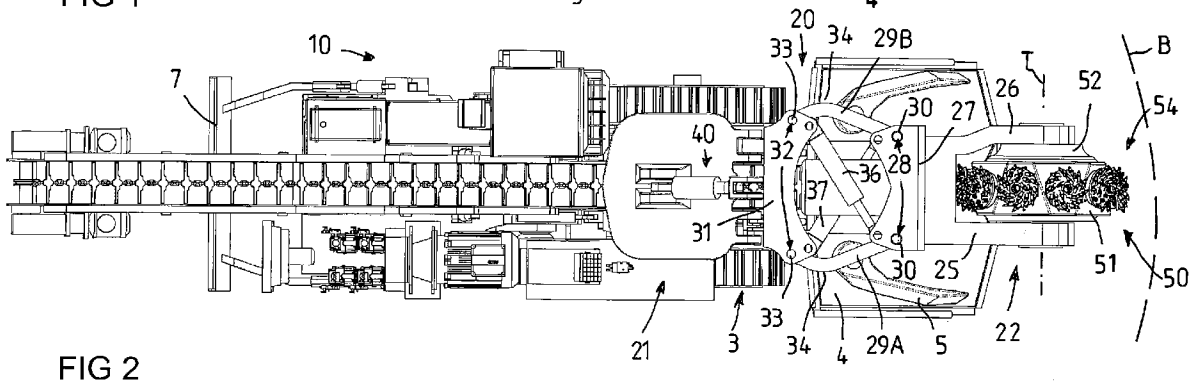
FIG. 2 shows the mobile mining machine from FIG. 1 in plan view.

In FIGS. 1 and 2, a mobile mining machine, in particular for driving or advancing tunnels, roadways or shafts in hard rock, is designated overall by reference sign 10. The mining machine 10 has a machine base frame 1 with a driver's cab 2 and various drives and working implements, which can be moved by means of a crawler undercarriage 3. In the exemplary embodiment shown, the mobile mining machine 10 is provided at its front end with a loading ramp 4, in which, as FIG. 2 shows in particular, gripping fingers 5 are arranged, here two gripping fingers 5. With these, material which is stripped by means of stripping tools 54 on a machine drum 50 frontally ahead of the mining machine 10 at a drift or heading face B that is schematically indicated in FIG. 2 can be transferred to a transporting belt 6. The transporting belt 6 is laid essentially parallel to the centre longitudinal axis of the mining machine 10 and extends through this machine as far as the loading ramp 4, in order to transport the extracted material from the material-removal region in the region of the tool drum 50 away and then transfer it to suitable belt or other material conveying devices (not shown) behind the mobile mining machine 10.

The base frame 1 is also provided at its rear end with a blade 7 for pushing away broken-off material during the rearward travel of the mining machine 10, which blade can be raised by means of a hydraulic cylinder 8. Also arranged on the machine base frame 1 are all the drive devices, such as for example a drive motor 9, for the crawler undercarriage 3 and a swinging drive 11, which has a slewing ring for swinging a boom device 20, on the front end of which the tool drum 50 is mounted such that it can be rotatably driven. The slewing ring of the slewing device is arranged on a carriage device 19, by way of which the swinging device 11 along with the boom device 20 can be pushed forwards or retracted in relation to the machine base frame 1 without the crawler undercarriage 3 being operated.

Figure 3:
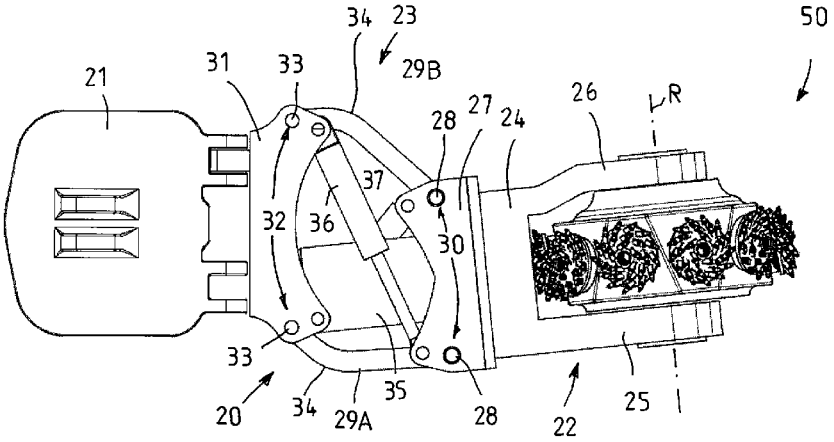
FIG. 3 shows a plan view of a detail of the boom device in the case of the mobile mining machine from FIG. 1 with a single tool drum and with some of the components omitted.
Figure 4:
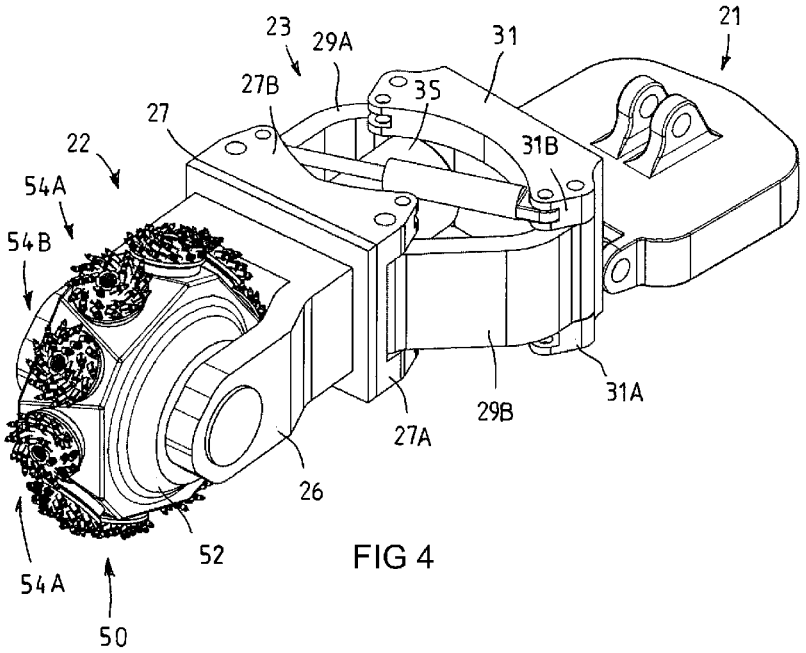
FIG. 4 shows the boom device from FIG. 3 in a perspective view.

The structure of the boom device 20 and the operating mode made possible thereby of the tool drum 50, is now explained with additional reference to FIGS. 3 and 4. The boom device 50 consists essentially of a swinging base 21, which can be swung by means of the swinging device 11, only schematically indicated in FIG. 1, about a swing axis S arranged along the longitudinal axis of the mobile mining machine 10 and extending perpendicularly to the base frame 1, a frontally fork-like supporting arm 22, on which the tool drum 50 is rotatably mounted, and a system of guide bars 23, which connects the swinging base 21 and the supporting arm 22 to one another adjustably within limits, here in the manner of a trapezoidal four-bar linkage system. The supporting arm 22 is formed like a fork head and has two bearing arms 25, 26, which are connected to one another by way of a base 24 and between which the tool drum 50 is rotatably held. The base 24 of the supporting arm 22 is rigidly connected here to a guide-bar bracket 27 on the supporting arm side, at the lateral ends of which in plan view bolt receptacles 28 are formed, in order to fasten a first guide-bar arm 29A and a second guide-bar arm 29B, of the same length of arm and arranged at a distance from said first arm, on the guide-bar bracket 27 on the supporting arm side such that they are able to swing about the guide-bar axes L, for example formed by means of guide-bar bolts 30. The respectively other ends of the guide-bar arms 29A, 29B are rotatably mounted on a second guide-bar bracket 31 on the swinging base side, which has for this purpose corresponding bolt receptacles 32 for guide-bar bolts 33 forming guide-bar axes L. The two guide-bar arms 29A, 29B form a pair of guide bars, which make it possible for the guide-bar brackets 27, 31 to be swung in relation to one another in a monitored, controllable manner. In the exemplary embodiment shown, the distance between the bolt receptacles 32 on the second guide-bar bracket 31 is greater than the distance between the bolt receptacles 28 on the first guide-bar bracket 27 on the supporting arm side, thereby producing a trapezoidal four-bar linkage system, which makes an oblique positioning of the guide-bar bracket 27 in relation to the guide-bar bracket 31 possible when adjusting the system of guide bars 23. In addition, both guide-bar arms 29A, 29B respectively have a crank 34, which lies off-centre, offset towards the second guide-bar bracket 32 in such a way that the portion of the guide-bar arm between the crank 34 and the first guide-bar bracket 27 is considerably greater than the portion of the arm between the second guide-bar bracket 32 and the crank 34. As shown for example by the views in FIGS. 1 and 4, the guide-bar brackets 27 and 31 respectively have essentially a U-shaped cross section, respectively with a bottom limb 27A and a top limb 27B on the guide-bar bracket 27 and a bottom limb 31A and a top limb 31B on the guide-bar bracket 31, which are respectively connected by way of a base plate. Extending between the mutually facing limbs 27A, 27B and 31A, 31B are the relatively sturdy guide-bar arms 29A and 29B, consisting essentially of plates that are curved and have their plate plane extending vertically. The guide-bar arms 29A, 29B are dimensioned in such a way that they can dependably transfer the entire weight of the tool drum 50 and the supporting arm 22, including all of the reaction forces occurring during operational use of the tool drum 50, to the second guide-bar bracket 31. Since the rotary drive 35 for driving the tool drum 50 in a rotating manner about the drum axis T is likewise supported here on the supporting arm 22, as still to be explained, the guide-bar arms 29A, 29B must be of correspondingly sturdy dimensions.

In the exemplary embodiment shown, the rotary drive 35 for driving the tool drum 50 is arranged in the space between the base plates of the guide-bar brackets 27, 31 and the guide-bar arms 29A, 29B and the output shaft of the rotary drive 35 is in connection with the tool drum 50 by way of a gear train, still to be explained, in such a way that the tool drum 50 can be driven in a rotating manner about the drum axis T. The gear train may for example be arranged in the here somewhat sturdier, straight-extending bearing arm 25 and preferably drive the tool drum 50 in such a way that an outer drum housing 51 is driven for example by way of a change-speed planetary gear mechanism arranged in a lateral mounting flange 52 between the tool drum 50 and the second bearing arm 26 of the supporting arm 22, while at the same time a stationary sun gear is arranged in the interior of the drum housing 51 and, for example by planetary gear mechanisms, can be used to achieve a rotation of the individual stripping tools 54 arranged on the circumference of the tool drum 50. This structure allows a rotation of stripping tools 54, which consist of tool cutters 61 arranged on the tool heads 60 of rotatable tool carriers 53, to be brought about by a single, central rotary drive 35.

In the exemplary embodiment as shown in FIGS. 1 to 8, the tool drum 50 has for this purpose rotatable tool carriers 53 on its lateral surface 51, every first, third, fifth . . . tool carrier 53 respectively forming a first group 54A of stripping tools 54 and every second, fourth, sixth . . . tool carrier 53 respectively forming a group 54B of stripping tools 54. Here, the tool drum has an even number of stripping tools 54, in the exemplary embodiment shown ten stripping tools 54, the stripping tools 54 of the group 54A rotating oppositely to the stripping tools 54 of the other group 54B.

Figure 7A:
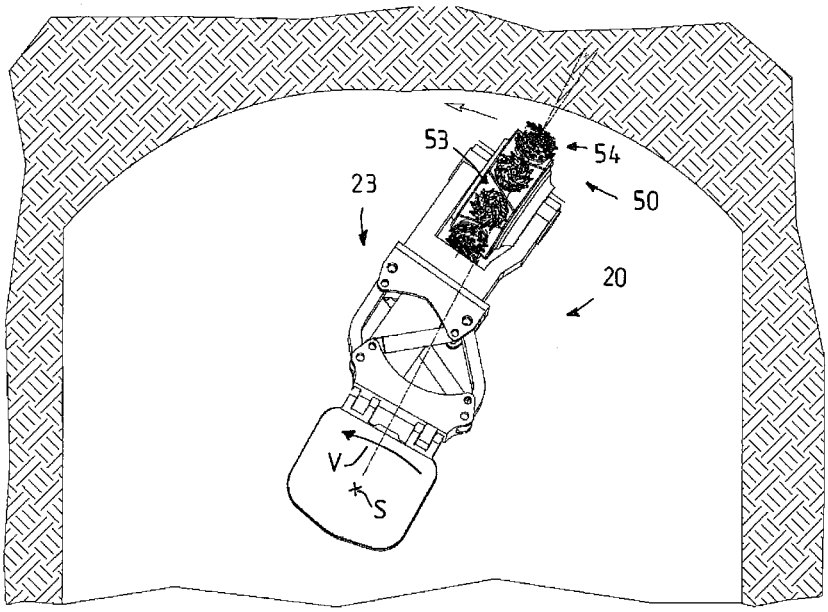
FIG. 7A-E schematically show a particularly advantageous method sequence for removing material in a plan view of the boom device that is shown in FIG. 1.
Figure 7B:
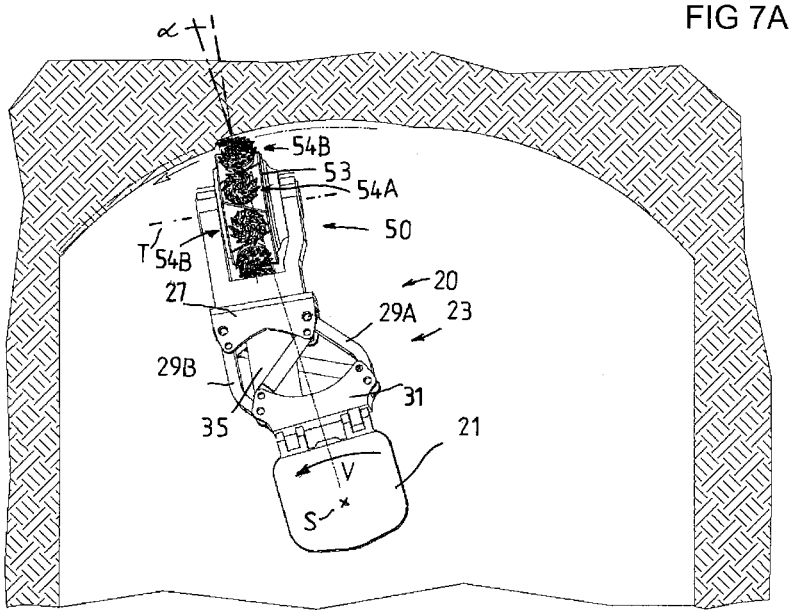
Figure 7C:
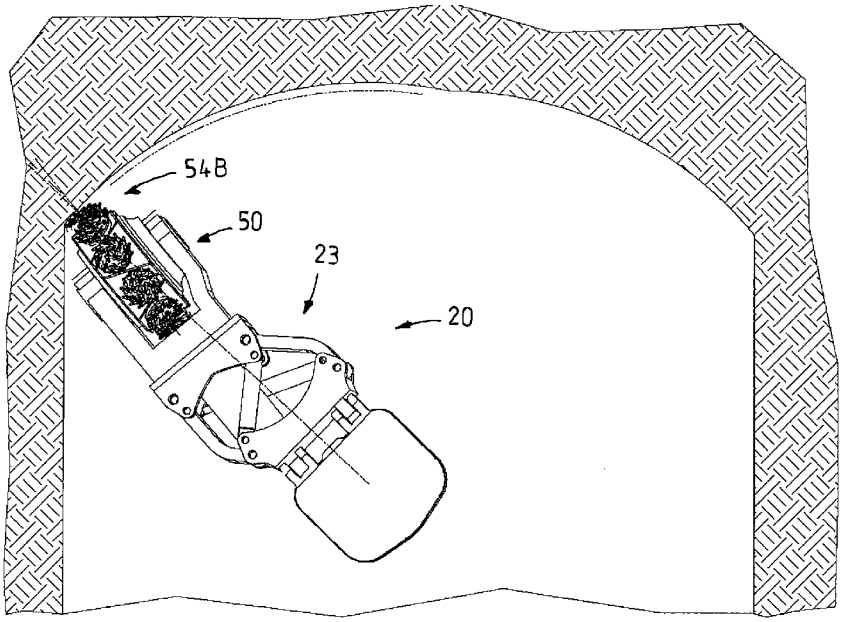
Figure 7D:
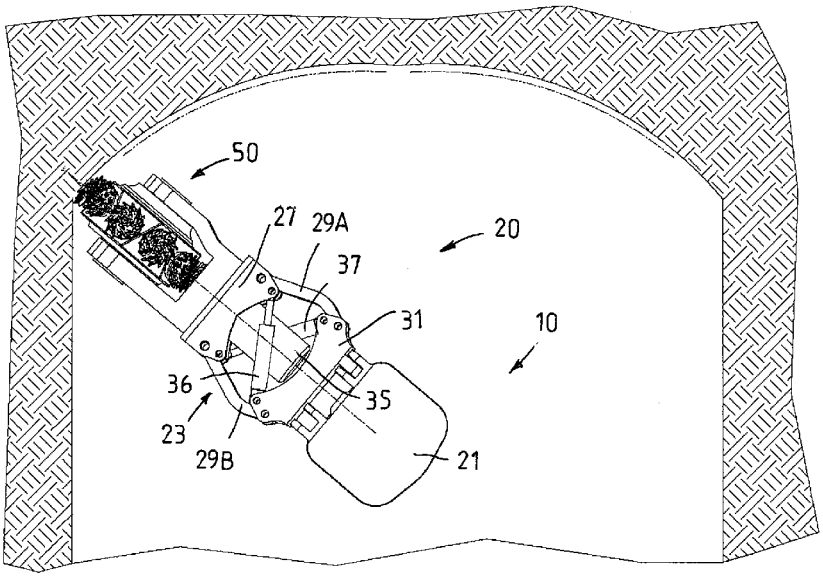
Figure 7E:
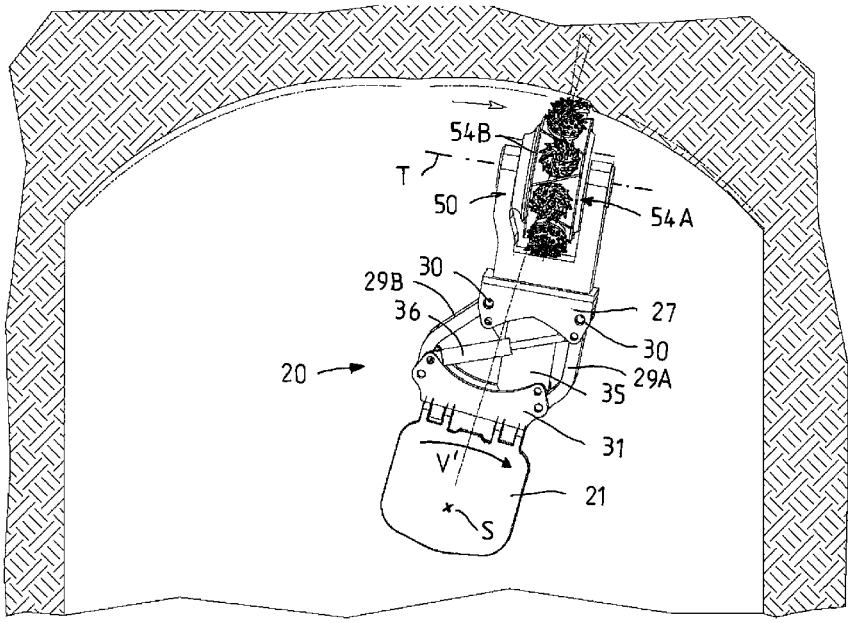
Figure 8:
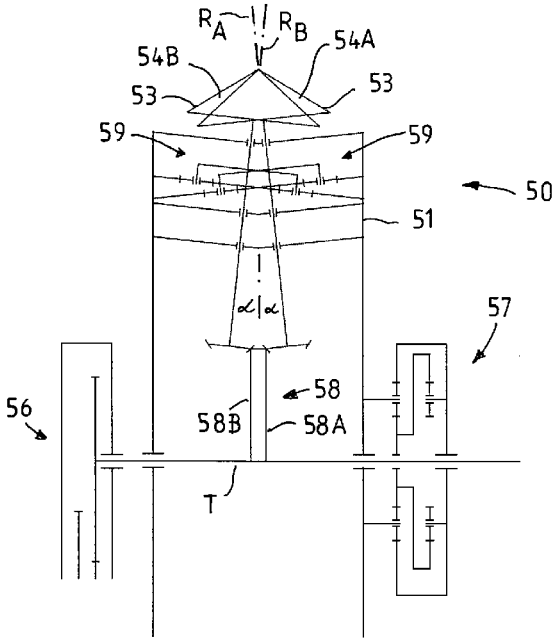
FIG. 8 schematically shows on the basis of a mechanism schematic the structure of a particularly advantageous tool drum.

A particularly advantageous structure of the tool drum 50 with oppositely rotating groups 54A, 54B of stripping tools 54 is now first explained on the basis of the mechanism schematic in FIG. 8. Arranged in the interior of the drum housing 51 of the tool drum 50 is a double helically toothed, preferably stationary sun gear 58, which can be used to achieve the effect when the tool drum 50 rotates about the drum axis T that the tool carriers 53 of the first group 54A rotate anticlockwise and the tool carriers 53 of the second group 54B rotate clockwise, while at the same time the tool drum 50 rotates about the drum axis T. As shown for example by FIG. 1, each tool carrier 53 of the groups 54A, 54B of stripping tools is provided here on its carrier head 60 with a number of tool cutters, in particular round-shank cutters 61, which point with their cutter tip in the respective direction of rotation so as to correspond to the direction of rotation of the respective tool carrier 53 of the groups 54A or 54B. In the exemplary embodiment in FIGS. 1 to 9, not only do adjacent tool carriers 53 have different directions of rotation, and consequently tool carriers of the group 54A have different directions of rotation than the group 54B, but in addition the axes of rotation RA of the tool carriers 53 of the group 54A are oblique to the normal to the drum axis T by the angle $\alpha$ and the axes of rotation RB of the tool carriers 53 of the group 54B are also oblique by the angle $\alpha$. This becomes clear best of all from the mechanism schematic for the tool drum 50 that is schematically indicated in FIG. 8. The central rotary drive is coupled for example to a spur gear stage 56 and drives thereby, and also preferably by way of a multi-stage planetary gear mechanism 57, the tool drum 50 about the stationary sun gear 58. Here, the sun gear 58 has a first bevel gear 58A, with helical teeth facing the planetary gear mechanism 57, and a second bevel gear 58B, with helical teeth facing the spur gear mechanism 56. The axis of rotation RA of the tool group 54A is oblique to the drum axis T of the tool drum 50 by an angle of $90°+\alpha$, with $\alpha=6°$ here, and the axis of rotation RB of the second tool group 54B is correspondingly oblique to the drum axis T by $90°-\alpha$. Planetary gear mechanisms 59 may also be respectively interposed between the sun gear 58 and the tool carriers 53 of the groups 54A, 54B, in order to increase the rotational speed of the tool carriers 53 correspondingly in relation to the tool drum 50. In operational use of the mobile mining machine 10, at least when the tool drum 50 is being swung about the swing axis S, the setting angle of the drum axis T of the tool drum 50 is set in such a way that only the stripping tools 54 of the group 54A or those of the other group 54B respectively perform stripping work at the drift or heading face.

Reference is now made to FIG. 7A to 7E, in which there is shown in plan view the method sequence for removing material with the mobile mining machine 10 along with the boom device 20 with the system of guide bars 23 between the tool drum 50 and the swinging base 21. FIG. 7A shows the boom device 20 of the mining machine 10, otherwise not represented to improve overall clarity, before the beginning of material removal at the working face, or the drift or heading face A. The boom device 20 is swung in the direction of the arrow V by swinging the swinging base 21 about the swing axis S, the stripping tools 54 on the single tool drum 50 not yet being in contact with the material to be removed at the working face B. The removal of material is respectively performed in a partial swing from the middle, for which reason the working face is advanced in a W-shaped manner. The system of guide bars 23 has already been adjusted for the subsequently following removal of material.

FIG. 7B shows the removal of material in the left half of the roadway or the tunnel to be driven during the partial swing of the boom device in the direction of the arrow V. The swinging movement of the boom device 20 is performed about the swing axis S in the direction of the arrow V, material being continuously removed at the drift or heading face B by means of the stripping tools 54 of the group 54B by a percussive movement of the rotating tool carriers 53 with at the same time a rotating tool drum 50. The stripping is performed here by continuous swinging of the swinging device 21 together with the tool drum 50 in a swinging operation about the swing axis S in the swinging direction V. In order however to achieve the effect that only one of the two groups of tool carriers 53 on the tool drum 50, here the stripping tools 54 of the group 54B lying obliquely inclined in the swinging direction V, removes material, the system of guide bars 23 is set in such a way that the drum axis T of the tool drum 50 is oblique or secantal in relation to the swing axis S of the swinging base 21, preferably by the same setting angle by which, as explained with reference to FIG. 8, the axes of rotation (RB) of the tool carriers 53 of the respective group 54B (54A) are oblique to the normal to the drum axis T. In the case of an angle of $\alpha=6°$, the drum axis T is then possibly also oblique to the swing axis S by this angle. The oblique positioning of the drum axis T becomes particularly clear from the oblique positioning of the base plates of the two guide-bar brackets 27, 31 in relation to one another. The base plate of the guide-bar bracket 31 is tangential to the swing radius about the swing axis S, whereas the base plate of the guide-bar bracket 27 is not. The representation in FIGS. 7A to 7E shows the mobile mining machine with the boom device 20 essentially not tilted, and in particular in this tilting position the oblique position of the setting angle can correspond to the angle $\alpha$. The adjustment of the setting angle by adjusting the system of guide bars 23 also has the effect that the distance of the guide-bar bolt 30 for the guide-bar arm 29B is greater than the distance of the joint bolt 30 for the guide-bar arm 29A from the swing axis S of the swinging base 21. In the representation according to FIG. 7B, the rotary drive 35 for the tool drum 50 is off-centre, near the guide-bar arm 29B that is leading in the swinging direction V, as a result of the swinging of the system of guide bars 23.

FIG. 7C shows the mining machine at the end of the first partial swing during the removal of material. The stripping tools 54B on the tool drum 50 that are performing stripping work at the time are still in engagement with the material on account of the current position of the system of guide bars 23. As shown in particular by a comparison of FIGS. 7C and 7D, when this swinging position is reached the system of guide bars 23 is activated. The adjustment of the system of guide bars 23 is performed by operating two actuating drives 36, 37 provided for this purpose, which may be formed for example by hydraulic cylinders and connect the guide-bar brackets 27, 31 above and below the rotary drive 35 to one another in a crosswise arrangement. In the representation according to FIG. 7D, the rotary drive 35 for the tool drum 50 is midway between the two guide-bar arms 29A, 29B on account of an adjusting movement of the two actuating drives 36, 37, and the base plates of the two brackets 27, 31 are parallel to one another. In this starting position of the system of guide bars 23, the second partial swing of a removal cycle may then be performed without removal of material, a removal of material at the working face B not normally taking place on account of the adjustment, possibly without travelling movement of the entire mobile mining machine 10 counter to the direction of advancement or without retracting movement of the boom device 10, on the basis of the midway, neutral setting angle of the system of guide bars 23. However, a short retracting movement of the boom device 20 may also be performed, by moving the mining machine counter to the direction of advancement or else by displacing the carriage to which the swinging base 21 is fastened, in order to increase the distance between the stripping tools 54 on the tool drum 50 and the working face B.

In this position of the system of guide bars 23, the swinging operation in the opposite swinging direction V' about the swing axis S that is shown in FIG. 7E then begins. With the beginning of the swinging operation in the swinging direction V', or else during the swinging operation, the system of guide bars 23 is then once again adjusted by means of the actuating drives 36, 37, to be precise in such a way that then, as shown in FIG. 7E, the guide-bar bracket 27 on the supporting arm side is angled with its base plate oppositely oblique in relation to the base plate of the guide-bar bracket 31, whereby the distance of the guide-bar bolt 30 of the second guide-bar arm 29B from the swing axis S is then shorter than the distance of the guide-bar bolt 30 on the guide-bar arm 29A that is then leading in the swinging direction. This opposite swinging of the system of guide bars 23 has the effect, as shown in FIG. 7E, that the rotary drive 35 between the guide-bar arms 29A, 29B is swung into its right-hand position, located near the guide-bar arm 29A, and the drum axis T of the tool drum 50 is once again set oblique to the swing axis S, for example by the angle a; the angle of the oblique positioning may correspond to the angle of the oblique positioning of the axes of rotation of the tool carriers 53 of the individual groups 54A, 54B, or else assume any intermediate value. In this oblique position of the system of guide bars 23, only the stripping tools 54A perform stripping work, while there is no contact between the stripping tools 54B and the drift or heading face or working face B. The different oblique positioning of the tool axes also results from the respectively oppositely tilted lateral surface segment caps on the lateral surface of the single tool drum 50.

Figure 5:
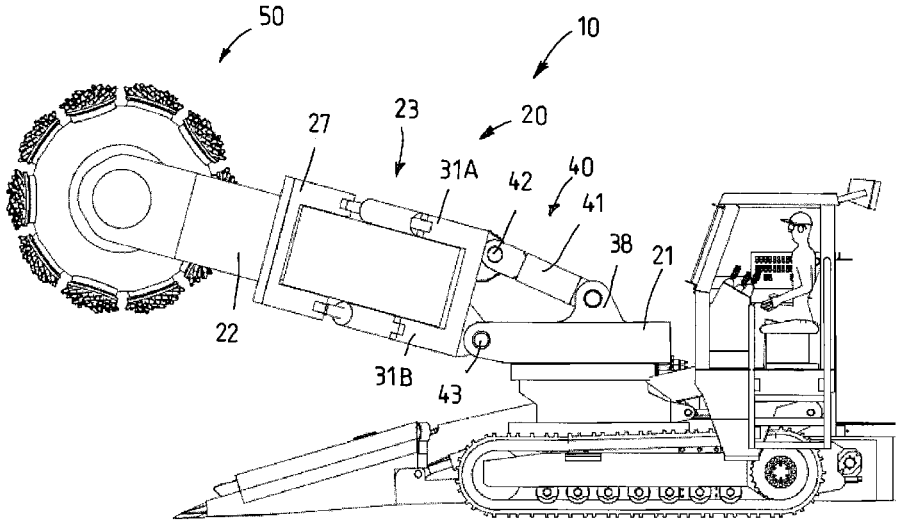
FIG. 5 shows the front region of the mobile mining machine with the tool drum tilted upwards.
Figure 6:
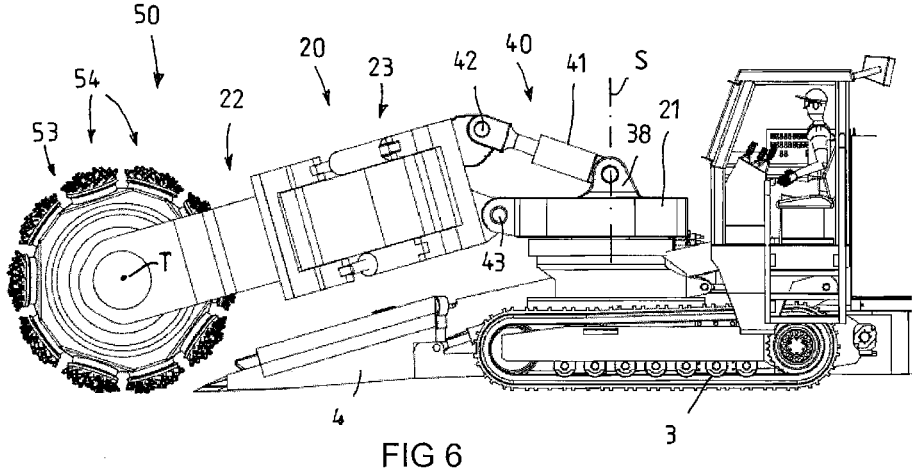
FIG. 6 shows the front part of the mobile mining machine with the tool drum tilted downwards.

With the boom device 20 lying horizontally with respect to the base frame, an oblique positioning of the drum axis T in relation to the swing axis S that corresponds to the greatest extent to the predetermined oblique positioning of the tool axes, and consequently the angle $\alpha$, can be set for the respective swinging operation. In normal tunnel advancement, however, material must usually be stripped in two, or at least two, seams at different heights, since the diameter of the drum wheel is virtually always smaller than the height to be achieved of the shaft, tunnel or roadway. FIGS. 5 and 6 illustrate how in the case of the mobile mining machine 10 a stripping operation can be brought about in different seams. FIG. 5 shows here an upwardly raised or tilted position of the tool drum 50 and FIG. 6 shows the mining machine 10 with a correspondingly lowered tool drum 50. For raising or lowering the tool drum 50, no tilting in the vertical direction takes place within the boom device between the guide-bar bracket 31 on the swinging base side, the guide-bar bracket 27 on the supporting arm side and the supporting arm 22, but instead the system of guide bars 23 and the supporting arm 22 form a unit in which only the drum axis T of the tool drum 50, and consequently the setting angle of the stripping tools on the tool drum 50, can be aligned obliquely in relation to the base plate of the guide-bar bracket 31. Serving for raising and lowering the tool drum is a tilting device 40, with which tilting of the entire front part of the boom device 20 in relation to the swinging base 21 can be brought about. For this purpose, the swinging base 21 is connected by way of a sturdy, horizontal swing bearing 43 to the base plate of the guide-bar bracket 31 on the swinging base side, essentially at the height of the bottom limb 31B of the guide-bar bracket 31, and furthermore a tilting cylinder 41 is attached at one end to the rear side of the guide-bar bracket 31, at the height of the upper limb 31A, and at the other end to the upper side of the swinging base 21, in order to tilt the guide-bar bracket 31 about the horizontal swing bearing 43 by adjusting the tilting cylinder 41. The tilting cylinder 41 is attached with its other cylinder end to a fork head 38, which is arranged in a fixed manner on the upper side of the swinging base 21, in the exemplary embodiment shown even essentially centrally above the swing axis. By extending or retracting the lifting cylinder 41, the entire front part of the boom device, comprising the system of guide bars 23 along with both guide-bar brackets 27, 31, setting cylinders 36, 37, guide-bar arms 29A, 29B, the holding arm 22, rotary drive 35 and the tool drum 50, can be tilted in the vertical direction about the swing bearing 43 without the tangential setting angle between the swing axis S and the drum axis T changing. The system of guide bars 23 on the other hand forms an additional degree of freedom, in order to be able to set the drum axis T obliquely or secantally with respect to the drift or heading face and the swing axis S, in order that only those stripping tools 54 on the tool drum 50 that are respectively set obliquely in the swinging direction with respect to the swinging direction V or V' perform stripping work, while the turned-away tool carriers 53 of the other group do not perform any stripping work during the swinging operation due to the adjustment of the setting angle. As a result, during the swing back, in which material is stripped over the entire width of the drift or heading face, and therefore no idle swing is required, it is possible to prevent wear on the individual cutters of the stripping tools 54 that are not being used for stripping at the time. Insofar as the tool drum 50 is tilted upwards or downwards by tilting the system of guide bars 23 along with the supporting arm 22 about the tilting joint 43, other setting angles may be predetermined, in order in this tilting position too to achieve an optimum angle of engagement of the cutter tips on the rotating tool carriers 53 in relation to the drift or heading face.

Figure 9:
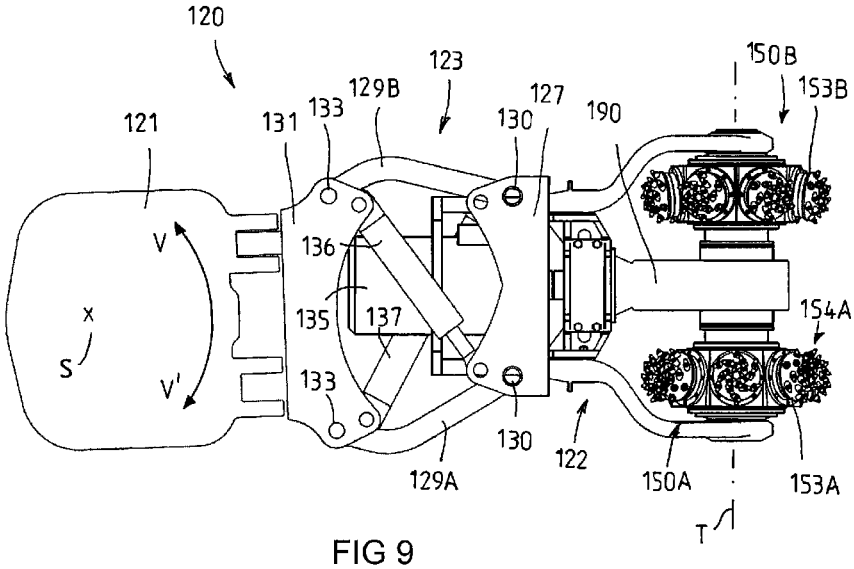
FIG. 9 shows an alternative configuration of a boom device with two tool drums in plan view, with some of the components omitted, for a mobile mining machine.

FIG. 9 shows an alternative configuration for a mobile mining machine, here only on the basis of the boom device 120, two tool drums 150A, 150B being arranged on the supporting arm 132 of the boom device 120. As in the case of the previous exemplary embodiment, the boom device 120 comprises a swinging base 121, to which the second guide-bar bracket 131 on the swinging base side is fastened in a tiltable manner, here by way of two tilting cylinders (not represented specifically) as a tilting device. The tilt axis of the guide-bar bracket 131 once again extends perpendicularly in relation to the swing axis S. The guide-bar bracket 131 on the swinging base side is connected to the first guide-bar base 127 on the supporting arm side by way of a trapezoidal four-bar linkage, the guide-bar mechanisms being formed by means of two guide-bar arms 129A and 129B of the same length, which are respectively articulated such that they can swing about guide-bar axes or guide-bar bolts 130 on the guide-bar bracket 127 and guide-bar bolts 133 on the guide-bar bracket 131. The distance between the guide-bar bolts 133 on the guide-bar bracket 131 is greater than the distance between the guide-bar bolts 130 on the guide-bar bracket 127, thereby producing a trapezoidal four-bar linkage, the swinging of which causes the setting angle of the drum axis T of both tool drums 150A, 150B to be adjusted in relation to the swing axis S. The rotary drive 135 for the tool drums 150A, 150B is again located midway between the two guide-bar arms 129A, 129B and also between the actuating cylinders 136, 137, the output shaft of the rotary drive 135 being coupled to the drive axes for the tool drum 150A, 150B by way of a gear train (not shown) arranged in a central arm 190. All of the tool carriers 153A on the tool drum 150A, which are fitted with the stripping tools 154A, rotate in the same direction and all of the axes of rotation of the tool carriers 153A arranged on the tool drum 150A are set obliquely by the same angle and in the same direction with respect to the normal to the drum axis T. All of the tool carriers 153B on the tool drum 150B are likewise inclined with their axes of rotation in relation to a normal to the drum axis T, but inclined in the correspondingly other direction in comparison with the tool drum 150A, so that the axes of rotation of the tool carriers 153A and 153B form an acute oblique positioning angle of here preferably 12°, and consequently there is an oblique positioning of each axis of rotation by half an oblique positioning angle of 6° each. In the exemplary embodiment shown, the direction of rotation of all the tool carriers 153A on the tool drum 150A and also of the tool carriers 153B on the tool drum 150B is identical, that is anticlockwise here, while the direction of rotation of both tool drums 150A, 150B is the same. With a suitable choice of mechanisms, however, even the boom device 120 could be given a chosen configuration in which the tool carriers 153A on the tool drum 150A rotate oppositely to the tool carriers 153B on the tool drum 150B, in order in dependence on the swinging direction to achieve the same removal conditions and impact angles of the stripping tools or stripping cutters in each case at the working face. Also with the boom device 120, the removal of material is performed in each case in a partial swing, material being removed with the tool drum 150B during a swinging movement about the swing axis S in the direction of the arrow V and with the tool drum 150A during a swinging movement of the boom device 120 in the swinging direction V'.

Figure 10:
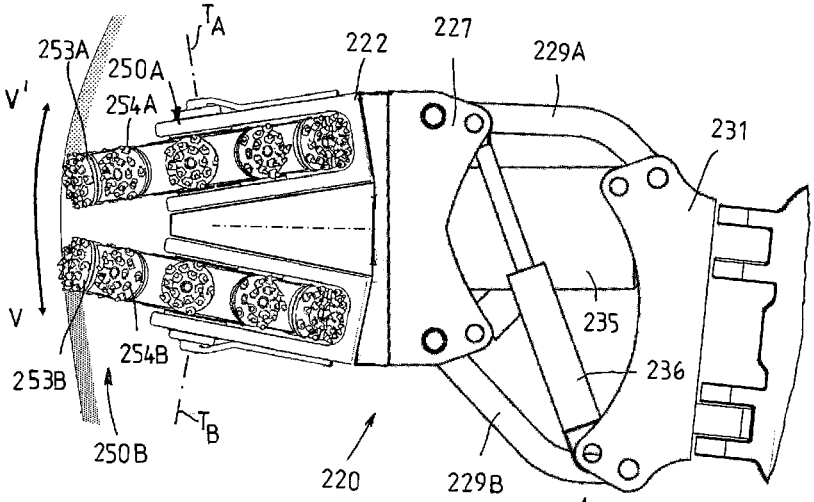
FIG. 10 shows a second alternative configuration of a boom device with two tool drums in plan view, with some of the components omitted, for a mobile mining machine.

FIG. 10 shows a further alternative exemplary embodiment of a boom device 220, which can be used on a machine frame of a mobile mining machine, as shown in FIG. 1. The swinging base and the tilting device are not represented in FIG. 10. The guide-bar bracket 231 on the swinging base side (shown in FIG. 10) is fastened to the swinging base, preferably in a tiltable manner, and, as in the case of the previous exemplary embodiments, is connected to the guide-bar bracket 227 on the supporting arm side by way of a four-bar linkage system, by means of two sturdy guide-bar arms 229A, 229B. The rotary drive 235 is once again seated between the two guide-bar brackets 227, 231 and the guide-bar arms 229A, 229B and the actuating drives 236 for adjusting the system of guide bars 223. Rotatably mounted on the supporting arm 232 are two tool drums 250A, 250B, the drum axis TA of the tool drum 250A running obliquely with respect to the base plate of the guide-bar bracket 227, and the drum axis TB of the tool drum 250B also running obliquely in relation to the base plate of the guide-bar bracket 227. The angle of the oblique positioning of the drum axes TA, TB is preferably the same as one another, but with different algebraic signs, so that the drum axes TA, TB form an obtuse angle of here preferably 178°. On account of the oblique positioning of the drum axes TA, TB, the axes of rotation of all the tool carriers 253A can be normal to the drum axis TA and the axes of rotation of all the tool carriers 253B on the tool drum 250B can be normal to the drum axis TB. Only the direction of rotation of the tool carriers 253A is opposite to the direction of rotation of the tool carriers 253B, while both tool drums 250A, 250B are driven in the same direction by way of the rotary drive 235 and an interposed gear mechanism. With the two obliquely positioned tool drums 250A, 250B, removal of material can be performed over the entire swinging path of the boom device along the working face, i.e., when the boom device 220 swings in one swinging direction V, material would be removed over the entire swinging path, followed by an adjustment of the system of guide bars 223, so that the rotary drive 235 is swung up to the respectively leading guide-bar arm, in the swinging direction V' consequently the guide-bar arm 229A, in order then to remove material in this swinging direction. The infeeding movement may then be initiated in each case on reaching the end position, by actuating the crawler undercarriage or advancing the boom device by way of the carriage device, before the swinging operation in the opposite swinging direction then commences and the rotary drive 225 is correspondingly brought up close to the other guide-bar arm 229B, in order to change the setting angle of the tool drum that is respectively active at the time, tool drum 250B. During the infeeding movement, both individual stripping tools 254A on the drum 250A and individual stripping tools 254B on the tool drum 250B can then possibly remove material for a short time, before, during the swinging operation, with the setting angle correspondingly adjusted, in each case only the stripping tools on the leading tool drum remove material. Adjusting the system of guide bars 223 consequently allows the tool drum that is in front in the swinging direction to be respectively brought into engagement with the material to be removed, while the trailing tool drum is oblique to the drift or heading face to be removed, in such a way that its tool cutters are specifically not in contact with the material to be removed and therefore do not perform any stripping work.

Figure 12:
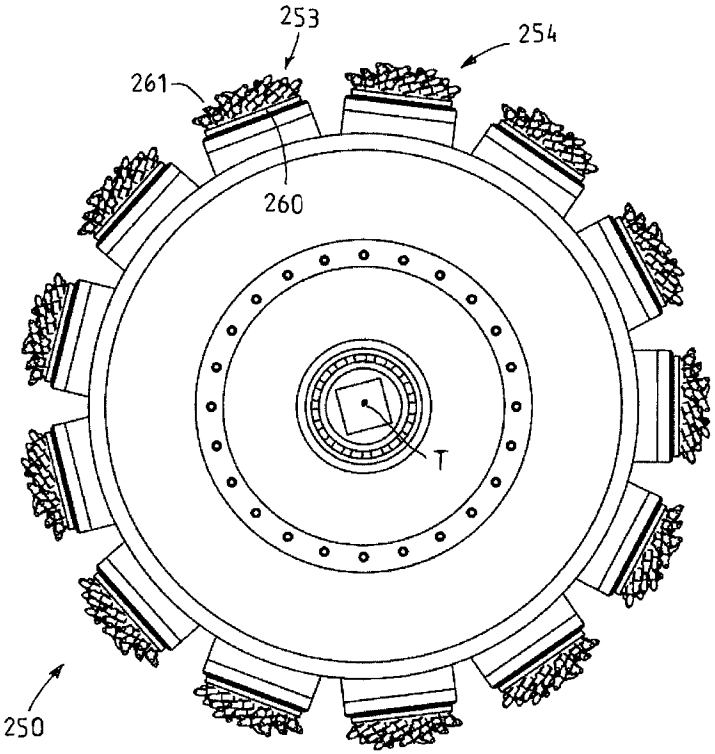
FIG. 12 shows the tool drum from FIG. 11 in side view.
Figure 11:
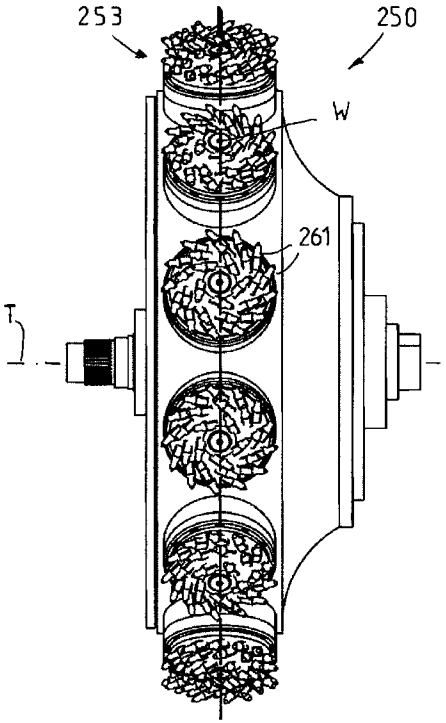
FIG. 11 shows a tool drum for the boom device from FIG. 10 in plan view.

FIGS. 11 and 12 show an advantageous configuration of a tool drum 250 for the boom device 220 of a mobile mining machine according to FIG. 10, with a system of guide bars 223 between the swinging base 221 and the supporting arm 222, on which tool drum 250 could be fitted twice, respectively with drum axes T oblique to one another. It can be seen well from FIG. 11 that, by contrast with the other exemplary embodiments, here all of the tool carriers 253 are arranged on the circumference of the tool drum 250 in such a way that the axes of rotation W of the individual tool carriers 253 extend perpendicularly to the drum axis T of the tool drum 250. In the case of the tool drum 250, the direction of rotation of all the tool carriers 253 is the same. With the tool drum 250, consequently, material is only removed in one swinging direction. However, the system of guide bars (223, FIG. 10) allows the setting angle of the stripping tools 254 to be correspondingly adjusted during the swinging operation, in order to achieve an optimum angle of engagement of the cutter tips of the tool cutters 261 on the individual tool carriers 253 of the tool drum that is active at the time independently of the height, and consequently the tilting position, of the boom device. As in the case of the previous exemplary embodiments, on the carrier head 260 of each tool carrier 253 tool cutters 261 are arranged on a number of pitch circles, the angular offset between the individual tool cutters 261 that form a tool cutter group on one pitch circle preferably being the same and the individual tool cutter groups being at a different radial distance from the axis of rotation W of the individual tool carriers 153, and preferably also a different radial distance from the drum axis T, as can be seen particularly clearly from FIGS. 11 and 12, but also for example from FIGS. 1 and 2.

As an alternative to the boom device that is shown in FIG. 10 with two tool drums, on which all the tool carriers rotate in the same direction, two separate tool drums could also be arranged on the supporting arm, the tool carriers on one tool drum rotating in one direction and the tool carriers on the other tool drum rotating in the other direction.

Figure 13:
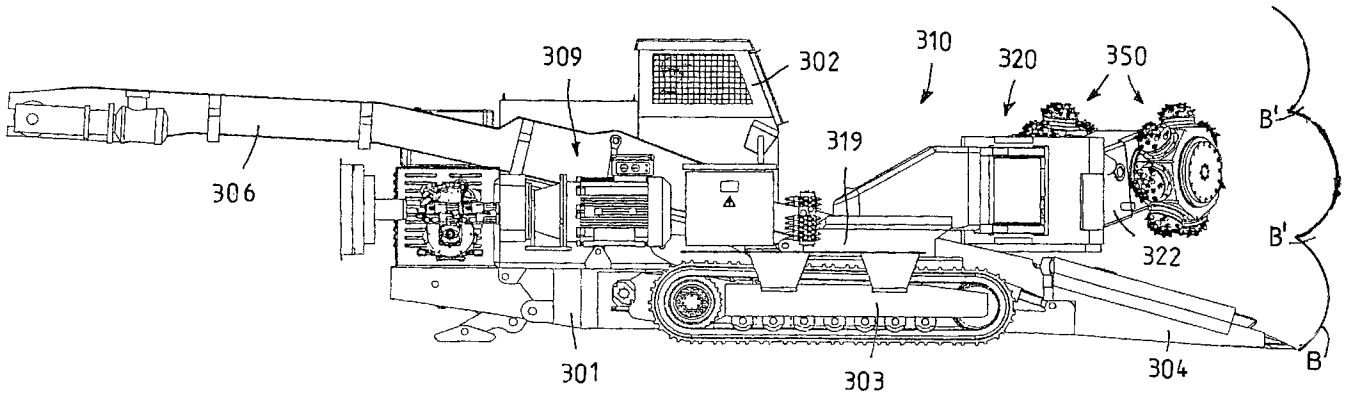
FIG. 13 schematically shows a further alternative configuration of a mobile mining machine according to the invention in side view.
Figure 14:
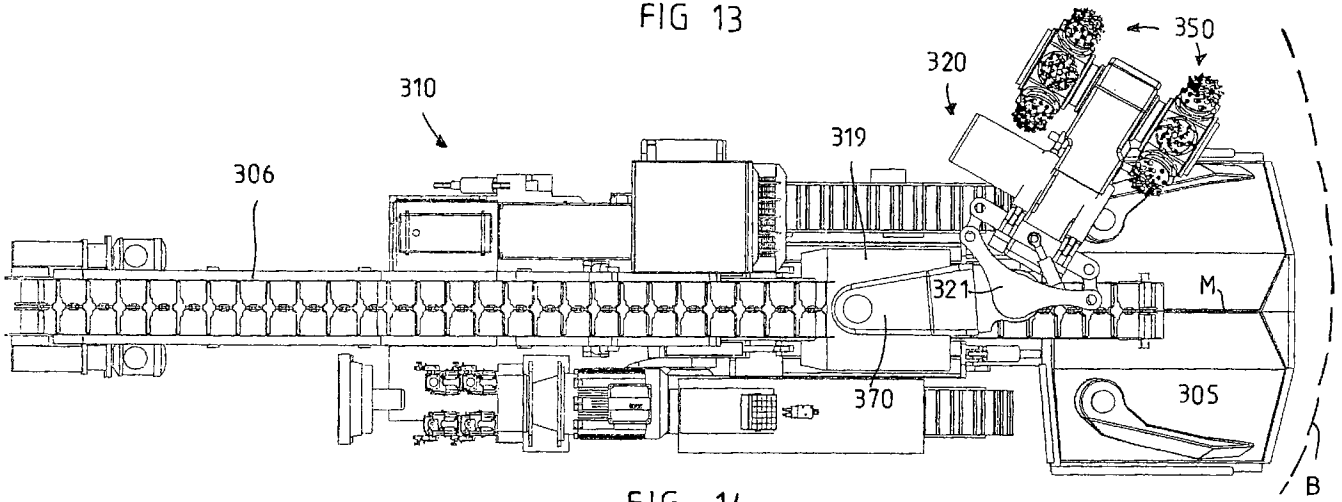
FIG. 14 shows the mobile mining machine from FIG. 13 in plan view.

In FIGS. 13 and 14, a mobile mining machine, in particular for driving or advancing tunnels, roadways or shafts in hard rock, is designated overall by reference sign 310. The mining machine 310 has a machine base frame 301 with a driver's cab 302 and various drives and working implements, which can be moved by means of a crawler undercarriage 303. In the exemplary embodiment shown, the mobile mining machine 310 is provided at its front end with a loading ramp 304, in which, as FIG. 14 shows in particular, gripping fingers 305 are arranged, here two gripping fingers 305. With these, material which is stripped by means of stripping tools 354 on at least one tool drum 350 frontally ahead of the mining machine 310 at a working face B that is schematically indicated can be transferred to a transporting belt 306. The transporting belt 306 is laid essentially parallel to the centre longitudinal axis M of the mining machine 310 and extends through this machine as far as the loading ramp 304, in order to transport the extracted material from the material-removal region in the region of the tool drum 350 away and then transfer it to suitable belt or other material conveying devices (not shown) behind the mobile mining machine 310.

Also arranged on the machine base frame 301 are all the drive devices, such as for example a drive motor 309, for the crawler undercarriage 303 and also a boom device 320, on the front end of which the tool drums 350, two here, are mounted such that they are able to be rotatably driven. The boom device 320 is supported on the machine base frame indirectly by way of a carriage device 319, by way of which the boom device 320 can be pushed forwards or retracted in relation to the machine base frame 301 without the crawler undercarriage 330 being operated.

Figure 15:
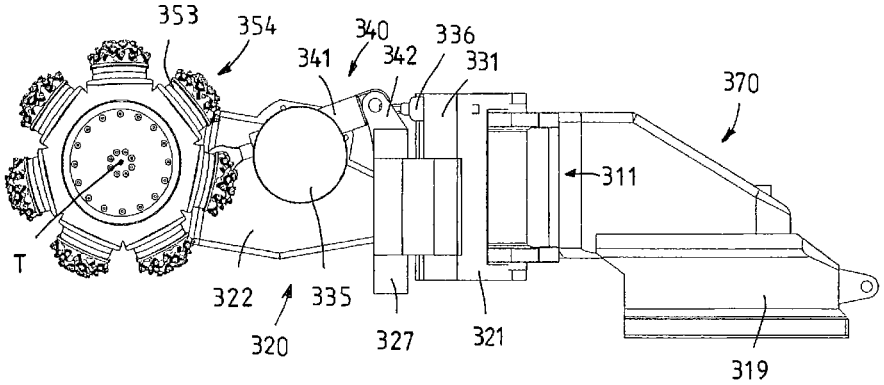
FIG. 15 shows a side view of a detail of the boom device of the mobile mining machine from FIG. 13, with some of the components omitted.
Figure 16:
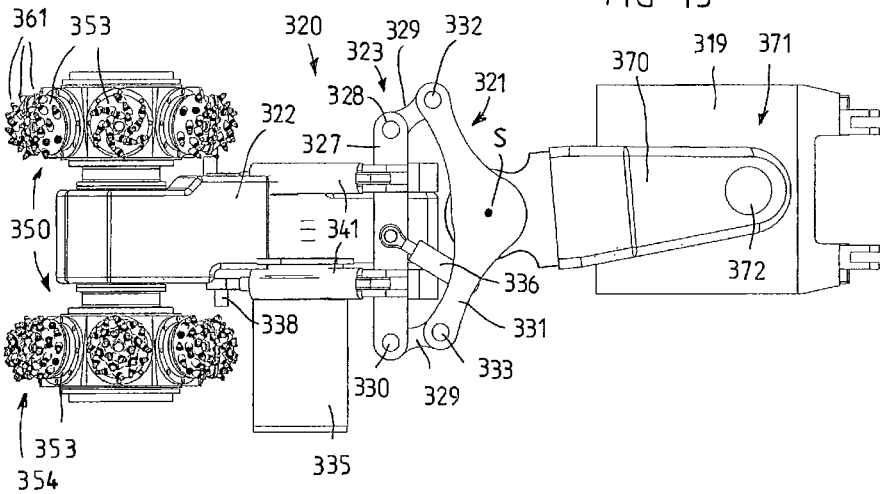
FIG. 16 shows the boom device from FIG. 15 in plan view.

An additional innovation of the mobile mining machine 310 is the structure of the boom device 320 and the operating mode made possible thereby of the tool drums 350 during material removal, and this is now explained with additional reference to FIGS. 15 and 16. The boom device 350 comprises a swinging base 321, which can be swung for example by means of a swinging cylinder or swinging gear train as a swinging device 311 about a swing axis S extending perpendicularly to the base frames 301, on both sides by preferably approximately ±60° to ±80° in relation to a middle position, in order to perform removal of material at the working face B with the swinging movement; the boom device 320 also has a supporting arm 322, on which the tool drum 350 is mounted such that it can be rotatably driven, and also a system of guide bars 323, which connects the swinging base 321 to the supporting arm 322 adjustably within limits, here in the manner of a trapezoidal four-bar linkage system. The supporting arm 322, ending with its front end midway between two tool drums 350, has a base, which is connected here in a tiltable manner about a horizontal tilting joint to a guide-bar bracket 327 on the supporting arm side, at the lateral ends of which in plan view bolt receptacles 328 are formed, in order to fasten a first guide-bar arm 329 and a second guide-bar arm 329, of the same length of arm and arranged at a distance from said first arm, on the guide-bar bracket 327 on the supporting arm side such that it is able to swing by way of guide-bar bolts 330. The respectively other ends of the guide-bar arms 329 are rotatably mounted on a second guide-bar bracket 331 on the swinging base side, which has for this purpose corresponding bolt receptacles 332 for further guide-bar bolts 333. The two guide-bar arms 329 form a pair of guide bars, which make it possible for the guide-bar brackets 327, 331 to be swung in relation to one another in a monitored, controllable manner. In the exemplary embodiment shown, the distance between the bolt receptacles 332 on the second guide-bar bracket 331 is greater than the distance between the bolt receptacles 328 on the first guide-bar bracket 327 on the supporting arm side, thereby producing a trapezoidal four-bar linkage system, which makes an oblique positioning of the guide-bar bracket 327 in relation to the guide-bar bracket 331 possible when adjusting the system of guide bars 323. As shown for example by the views in FIGS. 13 and 15, the guide-bar brackets 327 and 331 respectively have essentially U-shaped receptacles for the relatively sturdy guide-bar arms 329, consisting of plates that have their plate plane extending vertically. The guide-bar arms 329 are dimensioned in such a way that they can dependably transfer the entire weight of all the tool drums 350 and the supporting arm 322, including all of the reaction forces occurring during operational use of the tool drums 350, to the second guide-bar bracket 331 on the machine side. Since the rotary drive 335 for driving the tool drum 350 in a rotating manner about the drum axis T is likewise supported here on the supporting arm 322, as still to be explained, the guide-bar arms 329 must be of correspondingly sturdy dimensions.

In this exemplary embodiment, the rotary drive 335 for driving the tool drums 350 is flange-mounted laterally on the supporting arm 322 and an output shaft of the rotary drive 335 is in connection with the tool drums 350 by way of a gear train within the supporting arm 322 in such a way that the tool drums 350 can be driven in a rotating manner about the drum axis T. The gear train drives the tool drums 350 preferably in such a way that in each case an outer drum housing of the tool drums is driven for example by way of a change-speed planetary gear mechanism, while at the same time a stationary sun gear is arranged in the interior of the drum housing and, for example by means of planetary gear mechanisms, can be used to achieve a rotation of individual tool carriers 353 as stripping tools 354 arranged on the circumference of the tool drum 350. This structure allows a rotation of the stripping tools 354, which consist of tool cutters 361 arranged on the heads 360 of the rotatable tool carriers 353, to be brought about by means of a single, central rotary drive 335. The drive of the tool drums is preferably performed in such a way that the tool carriers 353 on one tool drum 350 are driven oppositely to the tool carriers 353 on the other tool drum 350. The axes of rotation of the tool carriers 353 are oblique to the normal to the drum axis T in a v-shaped manner in relation to one another, and the setting angle of the drum axis T in relation to the swing axis S can be adjusted by adjusting the system of guide bars 323. For operating the system of guide bars 323, an actuating cylinder is attached obliquely between the two guide-bar brackets 327, 331 as an actuating drive.

For height adjustment, the supporting arm 332 can be tilted by means of a tilting device 340, which here comprises two tilting cylinders 341, which are attached at one end to the supporting arm 322 and at the other end to the guide-bar bracket 337 on the supporting arm side. The supporting arm 322 is connected in a tiltable manner to the guide-arm bracket 327 by way of a horizontal tilting axis. The tilting cylinders 341 consist here of lifting cylinders, which are fastened with one cylinder end to a cylinder stop 338 on the supporting arm 320 and with their other end respectively to a cylinder stop 342 arranged on the first guide-bar bracket 327.

Arranged here between the swinging base 321, about which the entire supporting arm 320 together with the system of guide bars 323 can be swung, and the carriage device 319, which is arranged longitudinally displaceably on the machine base frame 301 of the mobile mining machine 310 (FIG. 13), is an additional swinging arm 370, which, as can be seen particularly well from FIGS. 14 and 15, is formed as a sturdy swinging block and can be swung with its end that is remote from the tool drum 350 on the carriage device 319 about a swinging joint 371 by means of a suitable swinging drive (not shown). The degree of freedom for the swinging of the swinging arm 370 about the swinging joint 371 as a swing bearing for the swinging arm 370 is preferably only a few degrees, and the swinging may be realized for example by way of a swivel pin 372 and cylinders that are not shown, which are fastened at one end to the swinging arm 370 and at the other end to the carriage device 319 and, by changing their length of extension, swing the swinging arm about the swivel pin 372. The front end on the supporting arm side of the supporting arm 370 in turn forms the abutment and swivel bearing for the swinging base 321, which in the exemplary embodiment shown coincides with the guide-bar bracket 331, so that operation of the swinging device 311 brings about swinging of the guide-bar bracket 331 or swinging base about the swing axis S, which is located at the front end of the swinging arm 370. Swinging of the swinging arm 370 once again allows the position of the swing axis S to be laterally displaced with respect to the longitudinal centre axis M of the mobile mining machine 310, and this will be explained with reference in particular to FIGS. 17A to 17D for material removal at a working face B.

Figure 17A:
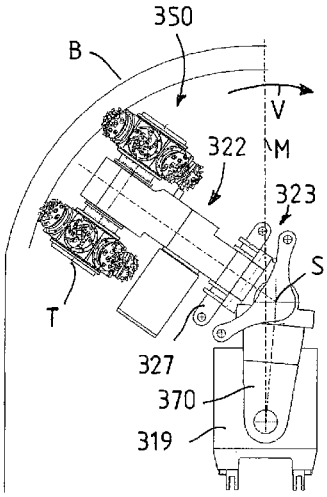
FIG. 17A-D shows the sequence when removing material with the various swinging positions of the swinging arm in the case of the boom device that is shown in FIG. 15, partly in a simplified form.

FIG. 17A shows the swinging position of the supporting arm 322 at the beginning of a swinging operation in the direction of the arrow V. By adjusting the system of guide bars 323, the drum axis T is set in relation to the swing axis S in such a way that the tool drum 350 lying at the front in the swinging direction removes material at the working face B with its stripping tools, whereas the other tool drum 350 runs in the shadow of the leading tool drum 350 and to this extent does not come into contact with material at the working face B. The oblique positioning of the system of guide bars 333 is not represented in FIGS. 17A to 17B for reasons of overall clarity however, since it has already been explained in detail further above, to which reference is additionally made. As can be seen well from FIG. 17, for the operation of swinging the supporting arm 322 about the swing axis S, the swinging arm 370 has been swung into a position in which the swing axis S lies such that it is displaced with respect to the longitudinal centre plane M towards the side to which the swinging operation is taking place according to swinging direction S and a removal of material is intended to take place. A removal of material at the working face B preferably only actually takes place when the leading tool drum 350 reaches or goes beyond the longitudinal centre plane M, or the removal of material begins shortly before the longitudinal centre plane M is reached. During the swinging operation, the position of the swing axis S is preferably not changed, and so the swinging arm 350 is not operated but remains laterally offset in relation to the longitudinal centre axis M.

Figure 17B:
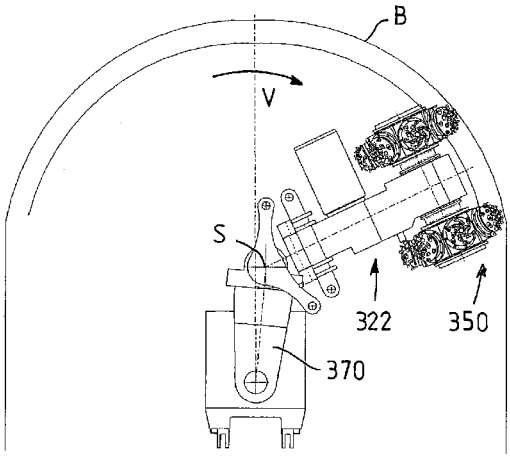
Figure 17C:
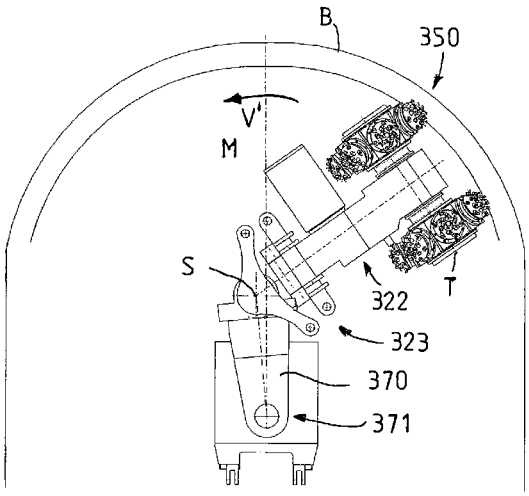

FIG. 17B shows the position of the supporting arm 322 at the end of the swinging operation in the swinging direction V, material having been removed with the leading tool drum 350 and the stripping tools thereof up to the opposite tunnel wall at an extraction height determined by the tilting position. In order to be able then to tilt the supporting arm 322 out of the swinging position according to FIG. 17B into another position in terms of height or extraction height, even though a slug of material B' has remained at the lower and upper edges of the cut performed, as shown at the working face in FIG. 13, or else to initiate a resetting of the setting angle of the drum axis T in relation to the swing axis S in a particular simple way, firstly, as shown in FIG. 17C, the swinging arm 370 is swung about the swing bearing 371 in the direction V', i.e. in the opposite swinging direction V' for a material removal swing, to be precise only by a few degrees. The required swinging angle for the swinging arm 370 depends in particular on the diameter of the cutting wheel. The swinging-back angle that is realized by means of the swinging arm 370 may lie for example at ±5°, as a result of which a minimum swinging angle that has to be realized by means of the swinging device 311 about the swing axis S of approximately ±60° is then obtained for a material-removing swing. Only once the swinging arm 370 has been operated is the setting angle of the drum axis T adjusted once again in relation to the swing axis S by operating the system of guide bars 323, and a swinging operation is initiated in the opposite swinging direction V' about the swing axis S. The possibility of being able to displace the position of the swing axis S with respect to the longitudinal centre axis M allows the structure of the system of guide bars 323 to be simplified in comparison with a boom device without a swinging arm 370, and consequently without the possibility of lateral displacement of the swing axis S, since the system of guide bars only has to be adjusted by a few degrees.

Figure 17D:
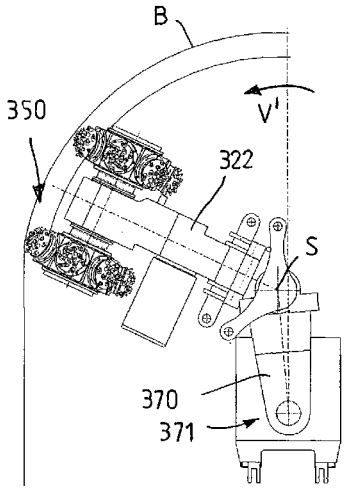

At the end of a material-removing swing in the direction of the arrow V', the supporting arm 332 with the tool drums 350 is in the position shown in FIG. 17D, a swing back of the swinging arm 370 about the swing bearing 371 then once again being initiated in this position, in order once again to displace the swing axis S laterally into the position shown in FIG. 17A. From this position, either a change of the position of the drum axis T in terms of height can be performed, by tilting the supporting arm 322 in relation to the guide-bar bracket 327, or a removal of material is performed in a partial swing, as explained with reference to FIG. 17A, once an adjustment of the cutting depth has been performed, for example by advancing the carriage device 319 or moving the entire mining machine 310.

The system of guide bars in the case of the mining machine in FIGS. 13 to 17 could also have the structure described further above: the same also applies to the structure and the arrangement of the tool drums. The mining machine could also be configured with only one tool drum with two groups of tool carriers, the position of the axis of rotation of the tool carriers of one group in relation to the drum axis being different than that of the other group. The configuration of the swinging arm and the way in which on the one hand the swinging arm is adjusted in relation to the carriage device and on the other hand the swinging base is swung relatively about the front end of the swinging arm could be realized in many different ways. The centre longitudinal axis does not have to lie centrally.

The foregoing description suggests to a person skilled in the art numerous further modifications that are intended to come within the scope of protection of the appended claims. The description of the exemplary embodiments is only schematic and is not intended to restrict the scope of protection of the appended claims. A mobile mining machine with a single tool drum and/or oppositely rotating stripping tools forms the particularly preferred configuration. Numerous modifications for the structure of the system of guide bars, the choice of the actuating members for the swinging device, the tilting device and the system of guide bars suggest themselves to a person skilled in the art. The dimensions and number of stripping tools on the circumference of the tool drum, the number of cutters per tool carrier, etc., may also be varied. Even though the preferred configuration has stripping tools that are arranged on rotating or rotatable tool carriers in order to break out the material at the drift or heading face, the stripping tools could also consist of cutting discs.

The invention claimed is:

1. A mobile mining machine for driving tunnels, roadways or shafts in hard rock, comprising:

a movable machine base frame having a boom device, a swinging device for swinging the boom device about a swing axis in relation to the machine base frame, and with a tilting device for tilting the boom device;

at least one tool drum coupled to the boom device for rotation about a drum axis;

a plurality of rotatable tool carriers arranged on a circumference of the tool drum;

a rotary drive for the tool drum;

wherein the boom device has a supporting arm, on which the tool drum is mounted, and a separate swinging base, which is swingable in relation to the machine base frame by the swinging device, and wherein the supporting arm and the swinging base are connected to one another by a system of guide bars, by way of which the setting angle of the drum axis in relation to the swing axis is adjustable; the system of guide bars forming a trapezoidal four-bar linkage, with a first guide-bar bracket on a supporting arm side and a second guide-bar bracket on a swinging base side, which are connected by way of guide-bar arms.

2. A mining machine according to claim 1, wherein the first guide-bar bracket is connected to the supporting arm in a fixed manner and the second guide-bar bracket is connected to the swinging base in a tiltable manner, the tilting device connecting the second guide-bar bracket and the swinging base to one another in a tiltable manner.

3. A mining machine according to claim 1, wherein the system of guide bars has two guide-bar arms, which are mounted with their one guide-bar end on the first guide-bar bracket and with their other guide-bar end on the second guide-bar bracket rotatably about guide-bar axes.

4. A mining machine according to claim 3, wherein the guide-bar axes run perpendicularly in relation to the drum axis, the distance between the guide-bar axes on the second guide-bar bracket being greater than the distance between the guide-bar axes on the first guide-bar bracket.

5. A mining machine according to claim 4, wherein the rotary drive is positioned between the guide-bar arms.

6. A mining machine according to claim 5, wherein the rotary drive is flange-mounted on the first guide-bar bracket or on the rear side of the supporting arm.

7. A mining machine according to claim 3, wherein the guide-bar brackets are movable in relation to one another by two actuating drives in a crosswise arrangement, one actuating drive being above the rotary drive, and the other actuating drive being below the rotary drive, connecting the guide-bar brackets.

8. A mining machine according to claim 3, wherein the guide-bar arms respectively have off-centre a crank, which in a mounted state lies closer to the second guide-bar bracket on the swinging base side than to the first guide-bar bracket.

9. A mining machine according to claim 1, wherein the tilting device comprises at least one lifting cylinder, which is fastened with one cylinder end to a cylinder stop on the swinging base and with its other end to a cylinder stop on the second guide-bar bracket.

10. A mining machine according to claim 1, wherein the swinging base is arranged on a longitudinally displaceable carriage device, enabling an adjusting of the cutting depth without movement of the mining machine.

11. A mining machine according to claim 1, wherein the rotatable tool carriers comprise a plurality of tool cutters arranged on a carrier head of the tool carriers.

12. A mining machine according to claim 11, wherein two groups of tool carriers are arranged on the circumference of the tool drum, with axes of rotation of the tool carriers of both groups being oblique to the drum axis and the tool carriers of the first group being rotatably driven oppositely to the tool carriers of the second group, the axes of rotation of one group preferably being oblique to the drum axis by an angle $(90°+\alpha)$ and the axes of rotation of the other group being oblique to the drum axis by an angle $(90°-\alpha)$.

13. A mining machine according to claim 11, wherein a number of tool cutter groups are formed on each tool carrier, with an angular offset of all the tool cutters of a tool cutter group being the same and the tool cutter groups having different radial distances from the axis of rotation of the tool carrier and a different distance from the drum axis.

14. A mining machine according to claim 1, further comprising a second tool drum mounted on the supporting arm and having a plurality of rotatable second tool carriers arranged on a circumference of the second tool drum, the tool carriers on the first tool drum preferably being able to be rotatably driven or being rotatably driven oppositely to the second tool carriers on the second tool drum.

15. A mining machine according to claim 14, wherein the axes of rotation of the tool carriers on the first tool drum and the axes of rotation of the second tool carriers on the second tool drum are oblique to the associated drum axis and the axes of rotation of the tool carriers on the first tool drum are oblique to the drum axis by an angle $(90°+\alpha)$ and the axes of rotation of the second tool carriers on the second tool drum are oblique to the drum axis by an angle $(90°-\alpha)$.

16. A mining machine according to claim 1, wherein a second tool drum is mounted on the supporting arm and includes a plurality of rotatable second tool carriers arranged on a circumference of the second tool drum, the drum axis of the first tool drum being oblique to the drum axis of the second tool drum and the tool carriers on the first tool drum being rotatably driven oppositely to the second tool carriers on the second tool drum.

17. A mining machine according to claim 15, wherein a lies between approximately 3° and 9°.

18. A mining machine according to claim 1, wherein the swinging base is arranged on a swinging arm and a further swinging joint is provided between the swinging arm and the machine base frame as a swing bearing for the swinging arm for lateral displacement of a position of the swing axis with respect to a longitudinal centre axis of the machine base frame.

19. A mining machine according to claim 18, wherein the first guide-bar bracket is connected to the swinging base in a fixed manner and the second guide-bar bracket is connected to the supporting arm in a tiltable manner, the tilting device being arranged between the second guide-bar bracket and the supporting arm.

20. A mining machine according to claim 19, wherein the guide-bar brackets are movable in relation to one another by an actuating drive.

21. A mining machine according to claim 20, wherein the tilting device comprises at least one lifting cylinder, which is fastened with one cylinder end to a cylinder stop on the supporting arm and with its other end to a cylinder stop arranged on the first guide-bar bracket.

22. A mining machine according to claim 21, wherein the swing bearing is arranged on a longitudinally displaceable carriage device, for adjusting a cutting depth without movement of the mining machine.

23. A mining machine according to claim 22, wherein two tool drums, each with tool carriers, are mounted on the supporting arm, the tool carriers on the first tool drum preferably being rotatably driven oppositely to the tool carriers on the second tool drum and the axes of rotation of the tool carriers on the first tool drum and the axes of rotation of the tool carriers on the second tool drum being oblique to the associated drum axis.

24. A mining machine according to claim 23, wherein the swinging arm is formed as a swinging block, which at an end on the machine side is supported on the swing bearing and at the end on the boom side forms a swinging receptacle for the swinging base.

25. A method for driving tunnels, roadways or shafts in hard rock with a mobile mining machine which has a movable machine base frame and at least one tool drum mounted on a boom device and is rotatable about a drum axis and has tool carriers with stripping tools arranged on the circumference of the tool drum, and also a swinging device for swinging the boom device about a swing axis, comprising:

removing material from a working face by swinging the boom device about the swing axis; and setting an angle of the drum axis of the tool drum in relation to the swing axis before and after each removal of material by operating a system of guide bars arranged between a supporting arm for the tool drum and the machine base frame; the system of guide bars having a trapezoidal four-bar linkage, with a first guide-bar bracket on a supporting arm side and a second guide-bar bracket on a swinging base side, which are connected by way of guide-bar arms.

26. The method according to claim 25, wherein the system of guide bars is arranged between a swinging base, which is swung in relation to the machine base frame by the swinging device, and the supporting arm, on which the tool drum is mounted.

27. A method according to claim 25, wherein the step of setting the angle of the drum axis of the tool drum in relation to the swing axis (S) is accomplished during the removal of material by operating the system of guide bars.

28. A method according to claim 25, wherein removal of material at the working face is performed from a middle section outwards in a partial swing, the system of guide bars of the boom device being adjusted after each removal of material.

29. A method according to claim 25, wherein an infeeding movement of the mining machine or the boom device is performed after each removal of material, after setting the angle.

30. A method according to claim 25, wherein removal of material at the working face during a swing of the boom device is performed over the entire working face, the angle being set during the infeeding movement in such a way that material is removed with tool cutters of all the tool carriers when cutting-in is carried out.

31. A method according to claim 26, wherein the swinging base is arranged together with the swinging device on a swinging arm and a further swinging joint is provided between the swinging arm and the machine base frame as a swing bearing for the swinging arm, the position of the swing axis with respect to a longitudinal centre axis of the machine base frame being laterally displaced by swinging of the swinging arm before and after each swinging operation.

32. A method according to claim 31, wherein the swing axis is positioned laterally in relation to the longitudinal centre axis during the swinging operation and before a tilting operation, the position of the swing axis is changed by moving the swinging arm.

33. A mobile mining machine for driving tunnels, roadways or shafts in hard rock, comprising:

a movable machine base frame having a boom device, a swinging device for swinging the boom device about a swing axis in relation to the machine base frame, and with a tilting device for tilting the boom device;

at least one tool drum coupled to the boom device for rotation about a drum axis;

a plurality of rotatable tool carriers arranged on a circumference of the tool drum and having a plurality of tool cutters arranged on a carrier head of the tool carriers;

a number of tool cutter groups on each tool carrier, with an angular offset of all the tool cutters of a tool cutter group being the same and the tool cutter groups having different radial distances from the axis of rotation of the tool carrier and a different distance from the drum axis;

a rotary drive for the tool drum;

wherein the boom device has a supporting arm, on which the tool drum is mounted, and a separate swinging base, which is swingable in relation to the machine base frame by the swinging device, and wherein the supporting arm and the swinging base are connected to one another by a system of guide bars, by way of which the setting angle of the drum axis in relation to the swing axis is adjustable.

34. A mining machine according to claim 33, wherein two groups of tool carriers are arranged on the circumference of the tool drum, with axes of rotation of the tool carriers of both groups being oblique to the drum axis and the tool carriers of the first group being rotatably driven oppositely to the tool carriers of the second group, the axes of rotation of one group preferably being oblique to the drum axis by an angle $(90°+\alpha)$ and the axes of rotation of the other group being oblique to the drum axis by an angle $(90°-\alpha)$.

35. A mobile mining machine for driving tunnels, roadways or shafts in hard rock, comprising:

a movable machine base frame having a boom device, a swinging device for swinging the boom device about a swing axis in relation to the machine base frame, and with a tilting device for tilting the boom device;

a first tool drum coupled to the boom device for rotation about a drum axis;

a plurality of rotatable first tool carriers arranged on a circumference of the first tool drum;

a rotary drive for the first tool drum;

wherein the boom device has a supporting arm, on which the first tool drum is mounted, and a separate swinging base, which is swingable in relation to the machine base frame by the swinging device, and wherein the supporting arm and the swinging base are connected to one another by a system of guide bars, by way of which the setting angle of the drum axis in relation to the swing axis is adjustable;

a second tool drum mounted on the supporting arm and having a plurality of rotatable second tool carriers arranged on a circumference of the second tool drum, the tool carriers on the first tool drum preferably being able to be rotatably driven or being rotatably driven oppositely to the second tool carriers on the second tool drum, wherein the axes of rotation of the first tool carriers on the first tool drum and the axes of rotation of the second tool carriers on the second tool drum are oblique to the associated drum axis and the axes of rotation of the first tool carriers on the first tool drum are oblique to the first drum axis by an angle $(90°+\alpha)$ and the axes of rotation of the second tool carriers on the second tool drum are oblique to the second drum axis by an angle $(90°-\alpha)$.

36. A mining machine according to claim 35, wherein a number of tool cutter groups are formed on each tool carrier, with an angular offset of all the tool cutters of a tool cutter group being the same and the tool cutter groups having different radial distances from the axis of rotation of the tool carrier and a different distance from the drum axis.

37. A mobile mining machine for driving tunnels, roadways or shafts in hard rock, comprising:

a movable machine base frame having a boom device, a swinging device for swinging the boom device about a swing axis in relation to the machine base frame, and with a tilting device for tilting the boom device;

at least one tool drum coupled to the boom device for rotation about a drum axis;

a plurality of rotatable tool carriers arranged on a circumference of the tool drum;

a rotary drive for the tool drum;

wherein the boom device has a supporting arm, on which the tool drum is mounted, and a separate swinging base, which is swingable in relation to the machine base frame by the swinging device, and wherein the supporting arm and the swinging base are connected to one another by a system of guide bars, by way of which the setting angle of the drum axis in relation to the swing axis is adjustable;

wherein the swinging base is arranged on a swinging arm and a further swinging joint is provided between the swinging arm and the machine base frame as a swing bearing for the swinging arm for lateral displacement of a position of the swing axis with respect to a longitudinal center axis of the machine base frame, and the first guide-bar bracket is connected to the swinging base in a fixed manner and the second guide-bar bracket is connected to the supporting arm in a tiltable manner, the tilting device being arranged between the second guide-bar bracket and the supporting arm.

38. A mining machine according to claim 37, wherein the guide-bar brackets are movable in relation to one another by an actuating drive.

* * * * *